US010589958B2

(12) United States Patent
Tracey

(10) Patent No.: US 10,589,958 B2
(45) Date of Patent: Mar. 17, 2020

(54) HOSE REEL ASSEMBLY

(71) Applicant: GREAT STUFF, INC., Austin, TX (US)

(72) Inventor: James B. A. Tracey, Austin, TX (US)

(73) Assignee: GREAT STUFF, INC., Austin, TX (US)

( * ) Notice: Subject to any disclaimer, the term of this patent is extended or adjusted under 35 U.S.C. 154(b) by 512 days.

(21) Appl. No.: 15/136,603

(22) Filed: Apr. 22, 2016

(65) Prior Publication Data

US 2016/0311643 A1 Oct. 27, 2016

Related U.S. Application Data

(60) Provisional application No. 62/151,638, filed on Apr. 23, 2015.

(51) Int. Cl.
*B65H 75/44* (2006.01)
*B65H 75/40* (2006.01)

(52) U.S. Cl.
CPC ..... *B65H 75/4471* (2013.01); *B65H 75/403* (2013.01); *B65H 75/4407* (2013.01); *B65H 75/4428* (2013.01); *B65H 75/4478* (2013.01); *B65H 2701/33* (2013.01)

(58) Field of Classification Search
CPC ..... B65H 75/4402; B65H 75/4434; B65H 75/4471; B65H 75/4478; B65H 75/4428; B65H 75/4407; B65H 75/403; B65H 2701/33
See application file for complete search history.

(56) References Cited

U.S. PATENT DOCUMENTS 2,063,843 A * 12/1936 Jensen ..... B65H 75/38 137/355.2
2,219,201 A * 10/1940 Smith ..... B65H 75/38 137/355.21
2,286,904 A * 6/1942 Ewald ..... B65H 75/38 137/355.26
2,394,363 A 2/1946 Bynoe
2,403,277 A * 7/1946 Hall ..... G08G 1/02 137/355.26
2,563,714 A * 8/1951 Foster ..... B65H 75/38 242/385.1
2,642,312 A * 6/1953 Shine ..... B65H 75/20 137/355.2
3,625,450 A * 12/1971 Lloyd, Jr. ..... B65H 75/4428 137/355.2

(Continued)

*Primary Examiner* — William A. Rivera
(74) *Attorney, Agent, or Firm* — Knobbe, Martens, Olson & Bear LLP

(57) ABSTRACT

A hose reel assembly can include a hose reel rotatable about a reel axis, and a first portion of linear material having a first proximal end portion and a first distal end portion, the first distal end portion configured to dispense a fluid. The hose reel assembly can include a second portion of linear material having a second proximal end portion connected to the hose reel and a second distal end portion. A connector can removably attach the second distal end portion of the second portion of linear material with the first proximal end portion of the first portion of linear material. A strain relief member can be configured to control an amount by which the second portion of linear material unspools from the hose reel.

21 Claims, 27 Drawing Sheets

(56) References Cited

U.S. PATENT DOCUMENTS

| | | | | |
|---|---|---|---|---|
| 4,227,661 | A | 10/1980 | King et al. | |
| 5,988,207 | A * | 11/1999 | Kownacki | B65H 75/38 137/355.27 |
| 6,065,490 | A | 5/2000 | Falcone, Jr. | |
| 6,279,848 | B1 * | 8/2001 | Mead, Jr. | B65H 75/40 242/397.3 |
| 6,779,745 | B2 | 8/2004 | Alexander et al. | |
| 7,527,213 | B2 * | 5/2009 | Weatherill | B65H 75/403 242/397.3 |
| 7,546,759 | B1 | 6/2009 | Gruenfelder et al. | |
| 8,317,121 | B2 * | 11/2012 | Tracey | B65H 75/4471 137/355.26 |
| 8,746,246 | B2 | 6/2014 | Lueckenhoff | |
| 8,801,458 | B2 * | 8/2014 | Ceraldi | H01R 13/72 439/501 |
| 2004/0206849 | A1 * | 10/2004 | Harrington | B65H 75/26 242/586 |
| 2004/0238675 | A1 * | 12/2004 | Banaszkiewicz | B65H 75/4402 242/377 |
| 2012/0138167 | A1 | 6/2012 | Zuppardo | |
| 2015/0122350 | A1 * | 5/2015 | Morgan | B65H 75/38 137/355.26 |

* cited by examiner

HOSE REEL ASSEMBLY

CROSS-REFERENCE TO RELATED APPLICATIONS

This application claims priority to U.S. Provisional Patent Application No. 62/151,638, filed Apr. 23, 2015, the contents of which are incorporated by reference herein in their entirety and for all purposes.

BACKGROUND

Field

The field relates generally to reels for spooling linear material and, in particular, to a reel including a connector for removably attaching two portions of linear material.

Description of the Related Art

Reels for spooling linear material, such as a hose or wire, onto a rotating drum have incorporated reciprocating motion of a guide through which the linear material passes, to advantageously cause the linear material to be wrapped substantially uniformly around most of the surface area of the drum.

Several methods have been utilized in the past for achieving such reciprocating motion. One common approach is to use a rotating reversing screw which causes a guide to translate back and forth in front of a rotating drum. For example, such an approach is shown in U.S. Pat. No. 2,494,003 to Russ. However, such reversing screws tend to wear out quickly, degrading reel performance and necessitating frequent replacement. Further, such reversing screws are bulky and increase the size of the reel assembly.

Another approach for producing reciprocating motion of the guide is to use a motor to control a rotating screw upon which the guide translates. In this class of reels, the motor reverses the direction of rotation of the screw whenever the guide reaches an end of the screw. Unfortunately, the repeated reversing of the motor increases the spooling time and causes the motor to wear down sooner. Other reels have incorporated significantly more complicated gear mechanisms for achieving the reciprocating motion.

Many reel constructions include exposed moving parts, such as the reel drum, guide, and motor. Over time, such moving parts can become damaged due to exposure. For example, an outdoor reel is exposed to sunlight and rain. Such exposure can cause the moving parts of the reel to wear more rapidly, resulting in reduced performance quality. Additionally, many reel constructions include additional parts outside the reel assembly, which increases the number of steps that the user has to take to use the reel or the number of parts the user must interconnect to use the reel, which increases the complexity of using the reel and is inconvenient for the user.

Thus, there is a need for a compact reel assembly having a reel with an improved reciprocating mechanism for efficiently distributing linear material across the reel drum and having an improved flow control mechanism.

SUMMARY

Accordingly, it is a principle object and advantage of the present invention to overcome some or all of these limitations and to provide an improved reel incorporating a reciprocating mechanism and an improved flow control mechanism.

In one embodiment, a hose reel assembly is disclosed. The hose reel assembly can include a hose reel rotatable about a reel axis. The hose reel assembly can include a first portion of linear material having a first proximal end portion and a first distal end portion, the first distal end portion configured to dispense a fluid. The hose reel assembly can include a second portion of linear material having a second proximal end portion connected to the hose reel and a second distal end portion. A connector can removably attach the second distal end portion of the second portion of linear material with the first proximal end portion of the first portion of linear material, the connector comprising a lumen configured to convey the fluid therethrough. The hose reel assembly can include a strain relief member configured to control an amount by which the second portion of linear material unspools from the hose reel.

In another embodiment, a hose reel assembly is disclosed. The hose reel assembly can include a housing and a hose reel rotatable about a reel axis, the hose reel disposed in the housing. A connecting portion of linear material can be fluidly connected to and at least partially disposed about the hose reel, the connecting portion of linear material disposed entirely within the housing during normal operation of the hose reel assembly. A connector can be configured to removably attach a distal end portion of the connecting portion of linear material with a proximal end portion of a working portion of linear material, the connector comprising a lumen configured to convey the fluid therethrough.

In yet another embodiment, a method for connecting a first portion of linear material to a hose reel is disclosed. The method can include accessing a second portion of linear material which is connected to the hose reel without disassembling a housing in which the second portion of linear material is disposed. The method can include adjusting a strain relief member to enable the second portion of linear material to at least partially unspool relative to the hose reel. The method can include connecting a proximal end portion of the first portion of linear material with a distal end portion of the second portion of linear material.

In accordance with another embodiment, a hose reel assembly is provided. The hose reel assembly comprises a rotatable member configured to rotate about a first axis to wind a hose onto the rotatable member or unwind the hose from the rotatable member. The rotatable member is also configured to rotate about a second axis that is substantially perpendicular to the first axis. The reel assembly further comprises a housing substantially enclosing the rotatable member, the housing comprising a first aperture configured to receive the hose therethrough and a second aperture spaced apart from the first aperture. The reel assembly further comprises a conduit assembly at least partially disposed within the housing and extending between a first end and a second end. The first end is configured to releasably and operatively couple with a liquid source, the first end being accessible through the second aperture and positioned substantially along the second axis. The second end is in fluid communication with a connector on the rotatable member that releasably couples to the hose, the conduit assembly further comprising a flow control valve coupled to a conduit portion of the conduit assembly. The flow control valve is configured to selectively allow fluid flow through the conduit assembly from the liquid source to the connector. The conduit assembly and the rotatable member are configured to move together about the second axis relative to at least a portion of the housing during operation of the rotatable member.

In accordance with another embodiment, a hose reel assembly is provided. The hose reel assembly comprises a rotatable member configured to rotate about a first axis to wind a hose onto the rotatable member or unwind the hose from the rotatable member. The rotatable member is also configured to rotate about a second axis that is substantially perpendicular to the first axis. The hose reel assembly further comprises a conduit assembly extending between a first end and a second end. The first end at least partially extends along the second axis and is configured to releasably and operatively couple with a liquid source. The second end is in fluid communication with a connector on the rotatable member that releasably couples to the hose. The conduit assembly further comprises a flow control valve coupled to a conduit portion of the conduit assembly, the flow control valve configured to selectively allow fluid flow through the conduit assembly from the liquid source to the connector. The hose reel assembly further comprises a housing substantially enclosing the rotatable member and conduit assembly. The housing comprises an upper housing portion and a lower housing portion, the upper housing portion being movable relative to the lower housing portion. The upper housing portion defines a first aperture configured to receive the hose therethrough, the housing comprising a second aperture aligned with the first end of the conduit assembly. The conduit assembly and the rotatable member are configured to rotate together about the second axis relative to at least a portion of the housing.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these aspects are intended to be within the scope of the invention herein disclosed. These and other aspects of the present invention will become readily apparent to those skilled in the art from the appended claims and from the following detailed description of the preferred embodiments having reference to the attached figures, the invention not being limited to any particular preferred embodiment(s) disclosed.

BRIEF DESCRIPTION OF THE DRAWINGS

These and other features, aspects and advantages of the present invention will now be described in connection with a preferred embodiment of the invention, in reference to the accompanying drawings. The illustrated embodiment, however, is merely an example and is not intended to limit the invention. The drawings include the following figures.

For ease of illustration, some of the drawings do not show certain elements of the described apparatus.

DETAILED DESCRIPTION

In the following detailed description, terms of orientation such as "top," "bottom," "upper," "lower," "front," "rear," and "end" are used herein to simplify the description of the context of the illustrated embodiments. Likewise, terms of sequence, such as "first" and "second," are used to simplify the description of the illustrated embodiments. Because other orientations and sequences are possible, however, the present invention should not be limited to the illustrated orientation. Those skilled in the art will appreciate that other orientations of the various components described above are possible.

Figure 1:
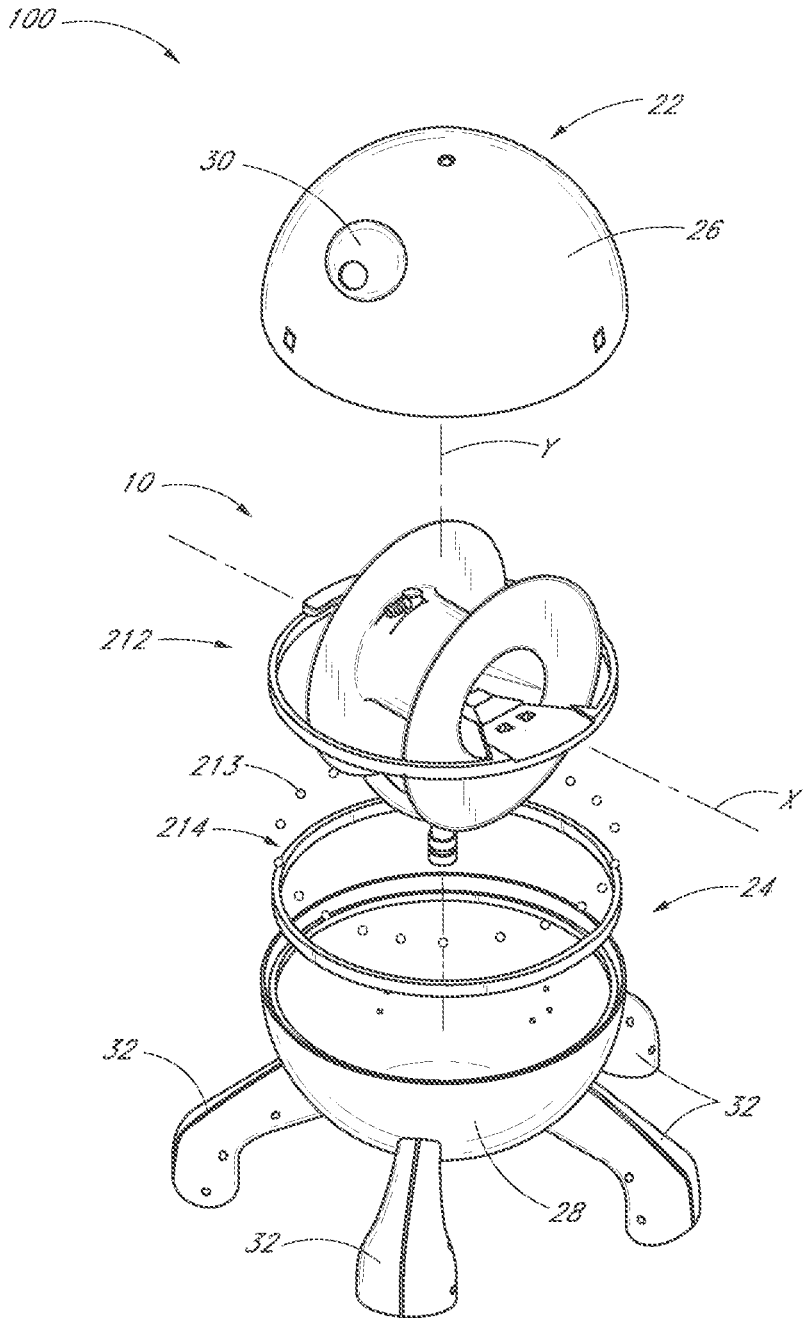
FIG. 1 is a front perspective view of a disassembled reel, including a housing, in accordance with one embodiment.

FIG. 1 illustrates one embodiment of a reel assembly 100 substantially enclosing a drum assembly 10 in a housing. In the illustrated embodiment, the housing includes an upper or top shell portion 22 and a lower or bottom shell portion 24.

Additionally, the upper and lower shell portions 22, 24 have the shape of upper and lower domes 26, 28, respectively, so that the reel assembly 100 has a generally spherical shape. However, the upper and lower shell portions 22, 24 can have any suitable shape, such as cylindrical and aspherical. As shown in FIG. 1, the upper shell portion 22 includes a guide member 30 with an aperture (not shown), which preferably guides a linear material, such as a water hose, into and out of the housing of the reel assembly 100 as the linear material is wound onto or unwound from the drum assembly 10. Additionally, the lower shell portion 24 is preferably supported by a plurality of legs 32. However, other types of legs or support structures can be used. In one embodiment, a circumferential stand supports the lower shell portion 24 on a support surface. Preferably, the lower shell portion 24 is movably supported with respect to a lower support surface, so that the reel assembly 100 is capable of moving along the surface. For example, the legs 32 or support structure can have rollers.

Figure 2:
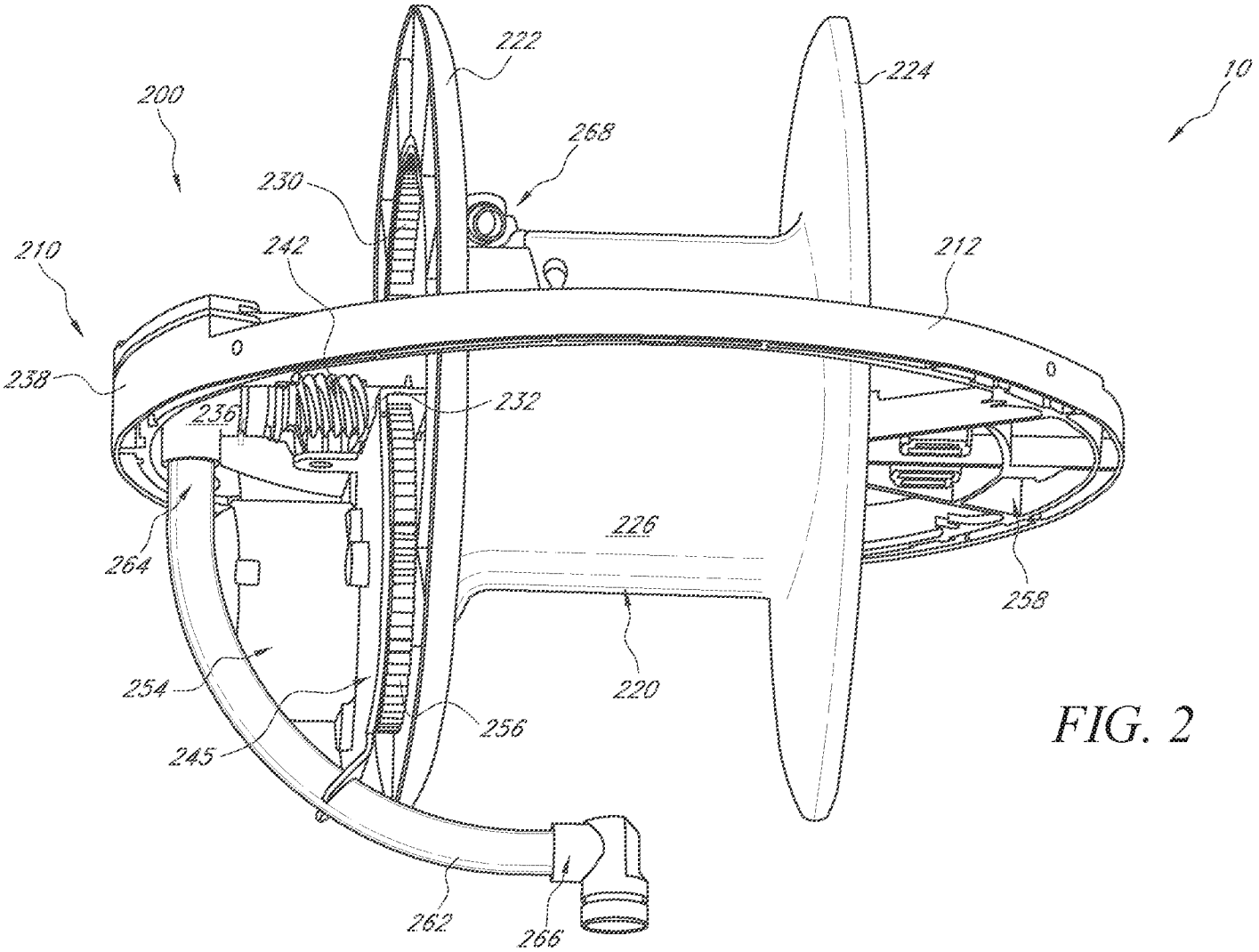
FIG. 2 is a bottom perspective view of a drum assembly with reciprocating mechanism, in accordance with one embodiment disclosed herein.

As seen in FIGS. 1 and 2, the drum assembly 10 defines a first or drum axis X about which the drum rotates. Additionally, a housing or second axis Y extends through the reel assembly 100. In a preferred embodiment, the housing axis Y is generally vertical and the drum axis X is generally horizontal, so that the housing axis Y is generally orthogonal to the drum axis X. Further details on reel assemblies can be found in U.S. Pat. No. 6,279,848, the entire contents of which are hereby incorporated by reference and should be considered a part of this specification.

FIGS. 2-7 illustrate one embodiment of a reciprocating mechanism 200 for a reel assembly. In one embodiment, the reciprocating mechanism 200 can be used with the reel assembly 100 illustrated in FIG. 1. The reciprocating mechanism 200 preferably includes a frame 210 comprising a top frame and a bottom frame. In the illustrated embodiment, the top frame includes an upper ring 212 and the bottom frame includes a lower ring 214 (see FIG. 1). In a preferred embodiment, the upper ring 212 is coextensive with and removably disposed on the lower ring 214. In another embodiment, the upper ring 212 overlaps the lower ring 214. The upper and lower rings 212, 214 are preferably fastened to the upper and lower shell portions 22, 24, respectively, via any suitable method. In one embodiment, the shell portions 22, 24 can be fastened to the rings 212, 214, respectively, using bolts or screws. In another embodiment, the shell portions 22, 24 can be clamped, welded, or adhesively secured to the rings 212, 214.

Figure 5:
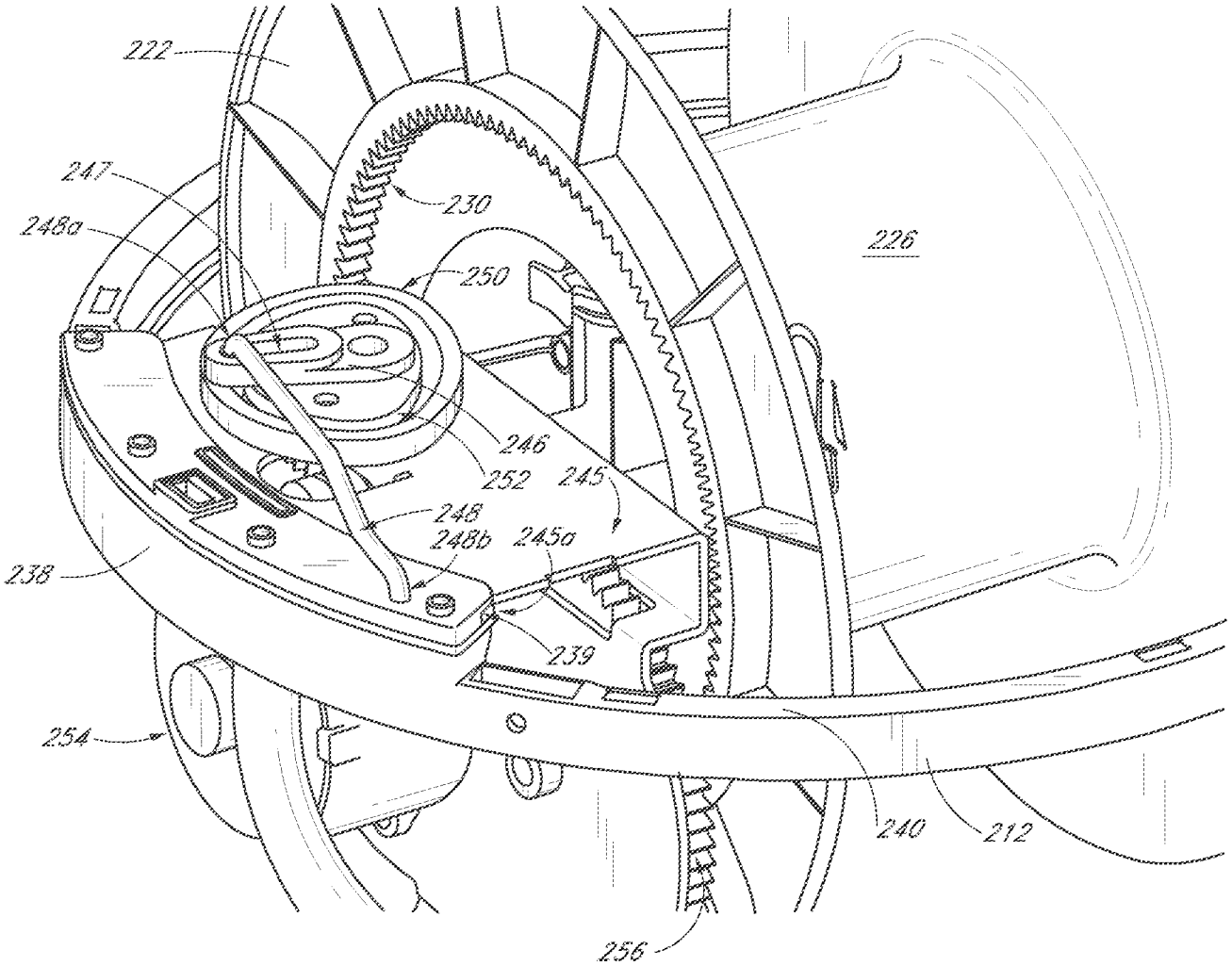
FIG. 5 is a top partially cut-away perspective view of the reciprocating mechanism shown in FIG. 2.

In a preferred embodiment, the upper ring 212 can rotate relative to the lower ring 214. For example, bearings (not shown) can be disposed between the upper and lower rings 212, 214. Preferably, the rings 212, 214 are sized to enclose a drum assembly 220, which consists of first and second endplates 222, 224 and a drum 226 disposed between the endplates 222, 224. As shown in FIGS. 2 and 5, a ring gear 230 is preferably attached to the first endplate 222.

Figure 3:
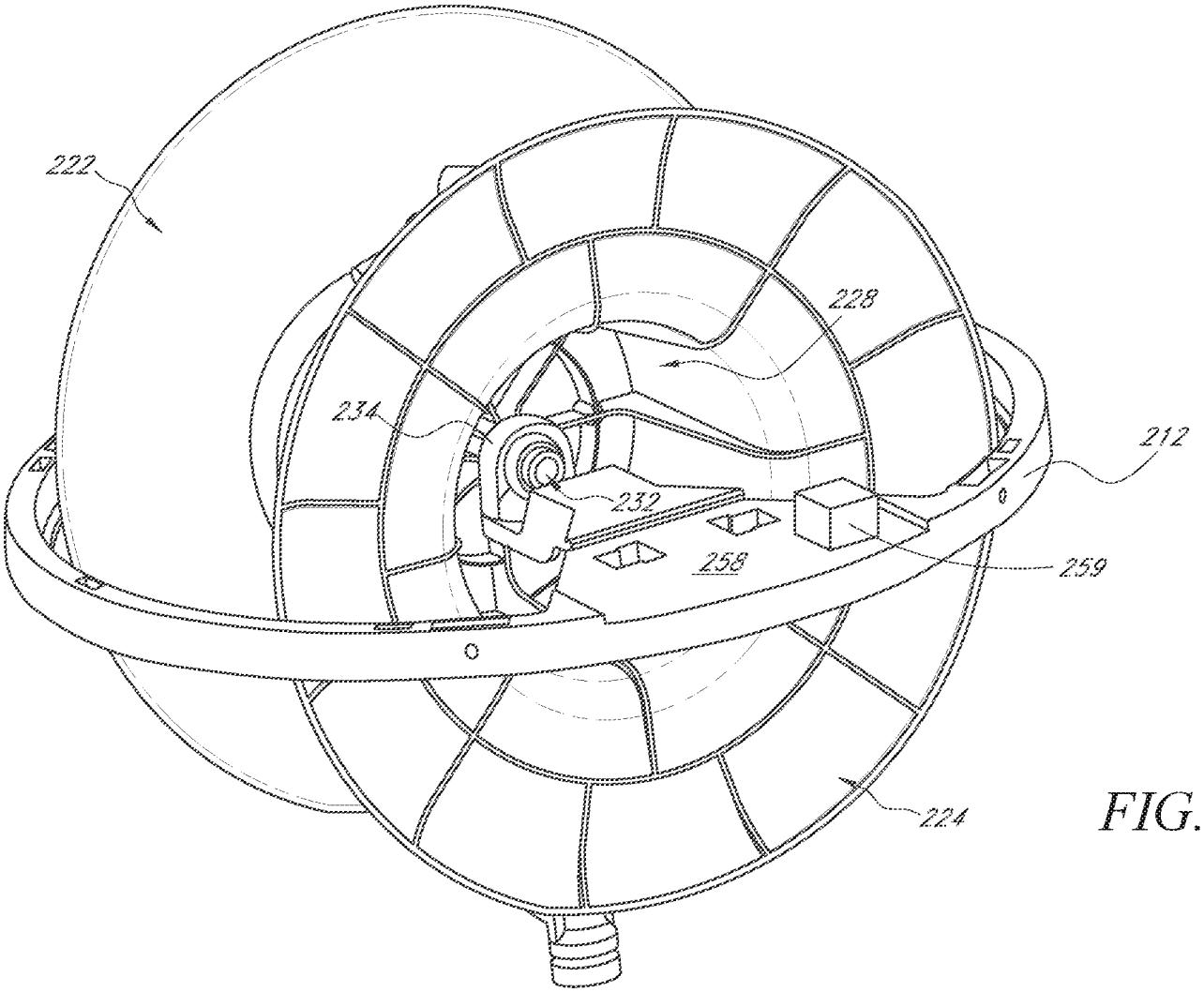
FIG. 3 is a top and side perspective view of one embodiment of a drum assembly.

The ring gear 230 is coupled to a shaft 232, which preferably extends into a hollow portion 228 of the drum 226 and rotatingly couples to a shaft support 234 disposed inside the hollow portion 228 (see FIG. 3). In one preferred embodiment, the shaft support 234 is disposed generally at the center of the upper ring 212. In another embodiment, the shaft support 234 can be offset from the center of the upper ring 212. Preferably, the shaft support 234 allows the shaft 232 to rotate freely therein. For example, in one embodiment, the shaft 232 can couple to the shaft support 234 via a bearing (not shown) disposed therein. As explained more fully below, the shaft 232 is preferably hollow so as to convey water. Additionally, the connection between the shaft 232 and the shaft support 234 preferably inhibits the leakage of fluid therebetween, as further discussed below. For example, in one embodiment, the connection between the shaft 232 and the shaft 234 includes a substantially water-tight seal.

The shaft 232 also connects to a fitting 236. The fitting 236 couples to a conduit member 262 disposed within the lower shell portion 24 and disposed below the lower ring 214. In the illustrated embodiment, the conduit member 262 is curved and has a first end 264 that connects to the fitting 236, which in turn connects to the shaft 232. The conduit member 262 has a second end 266 disposed generally along an axis Y2 extending generally perpendicular to the upper and lower rings 212, 214. In one embodiment, the shell axis Y and the axis Y2 are coaxial. Preferably, the second end 266 extends through an aperture (not shown) in the lower shell portion 24. In one preferred embodiment, the fitting 236 is not coupled to the upper ring 212. Further description of the fitting 236 and the conduit member 262 is provided below.

As shown in FIG. 5, an upper ring support member 238 extends from a surface 240 of the upper ring 212. In the illustrated embodiment, the upper ring support member 238 defines a slot 239 therein. Preferably, the slot 239 extends along the length of the support member 238 and is sized to slidingly receive one end 245*a* of a support frame 245 coupled to the conduit member 262. As shown in FIG. 5, the support frame 245 has a horizontal portion and a vertical portion, and the end 245*a* extends from the horizontal portion of the support frame 245. In one embodiment, at least one bearing (not shown) is disposed in the slot 239 to facilitate the sliding of the end 245*a* of the support frame 245 relative to the slot 239. However, other suitable methods for facilitating the sliding of the support frame 245 in the slot 239, such as, for example, applying a lubricant to at least one of the slot 239 and the end 245*a* of the support frame 245.

Preferably, the shaft 232 includes a worm gear section 242, which extends along at least a portion of the shaft 232. In one embodiment, the worm gear section 242 extends along substantially the entire length of the shaft 232. The shaft 232 is preferably integrally formed with the worm gear section 242. In another embodiment, the shaft 232 is removably coupled to the worm gear section 242 via, for example, a spline connection.

Figure 6:
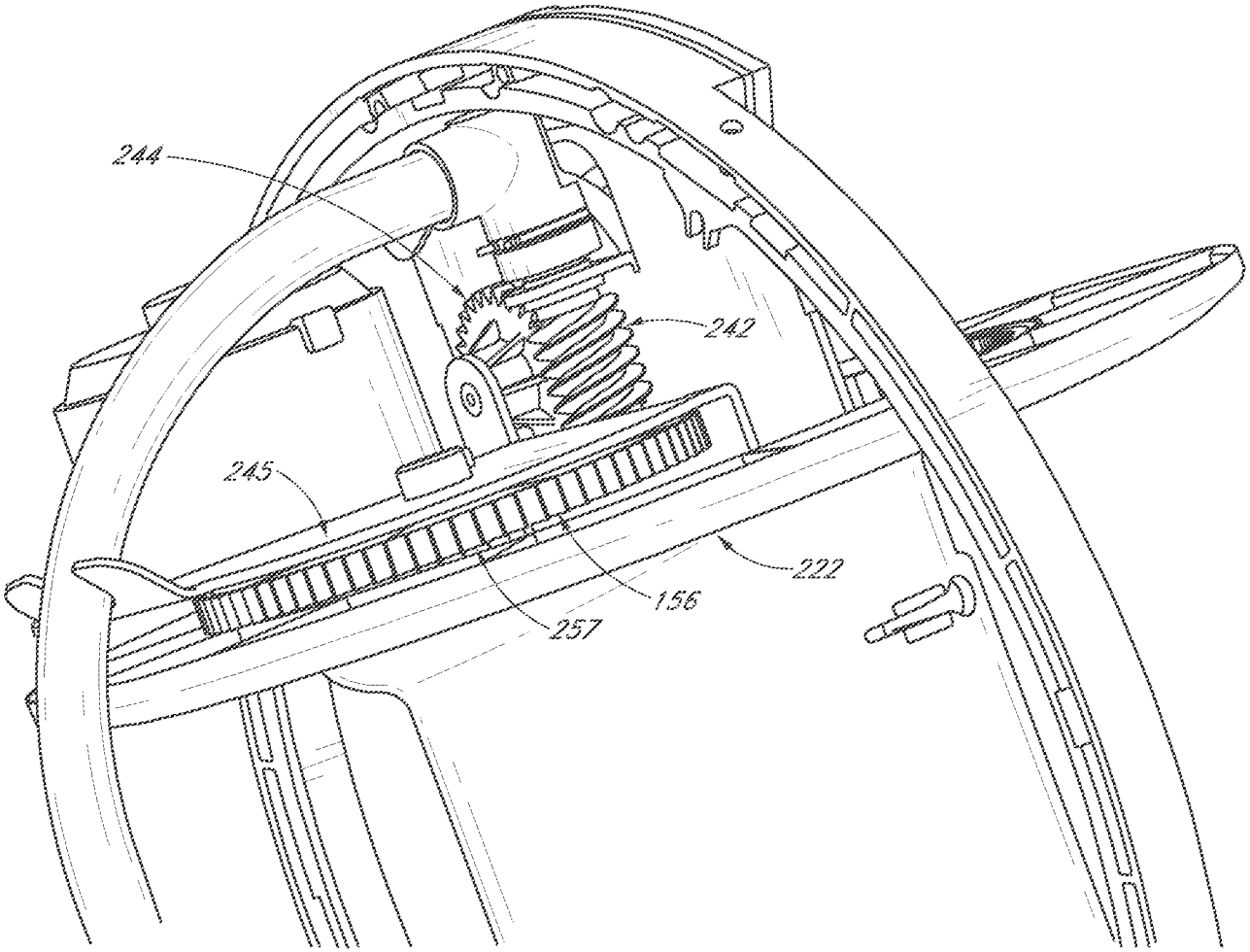
FIG. 6 is a bottom partially cut-away view of the reciprocating mechanism for a reel shown in FIG. 2.
Figure 7:
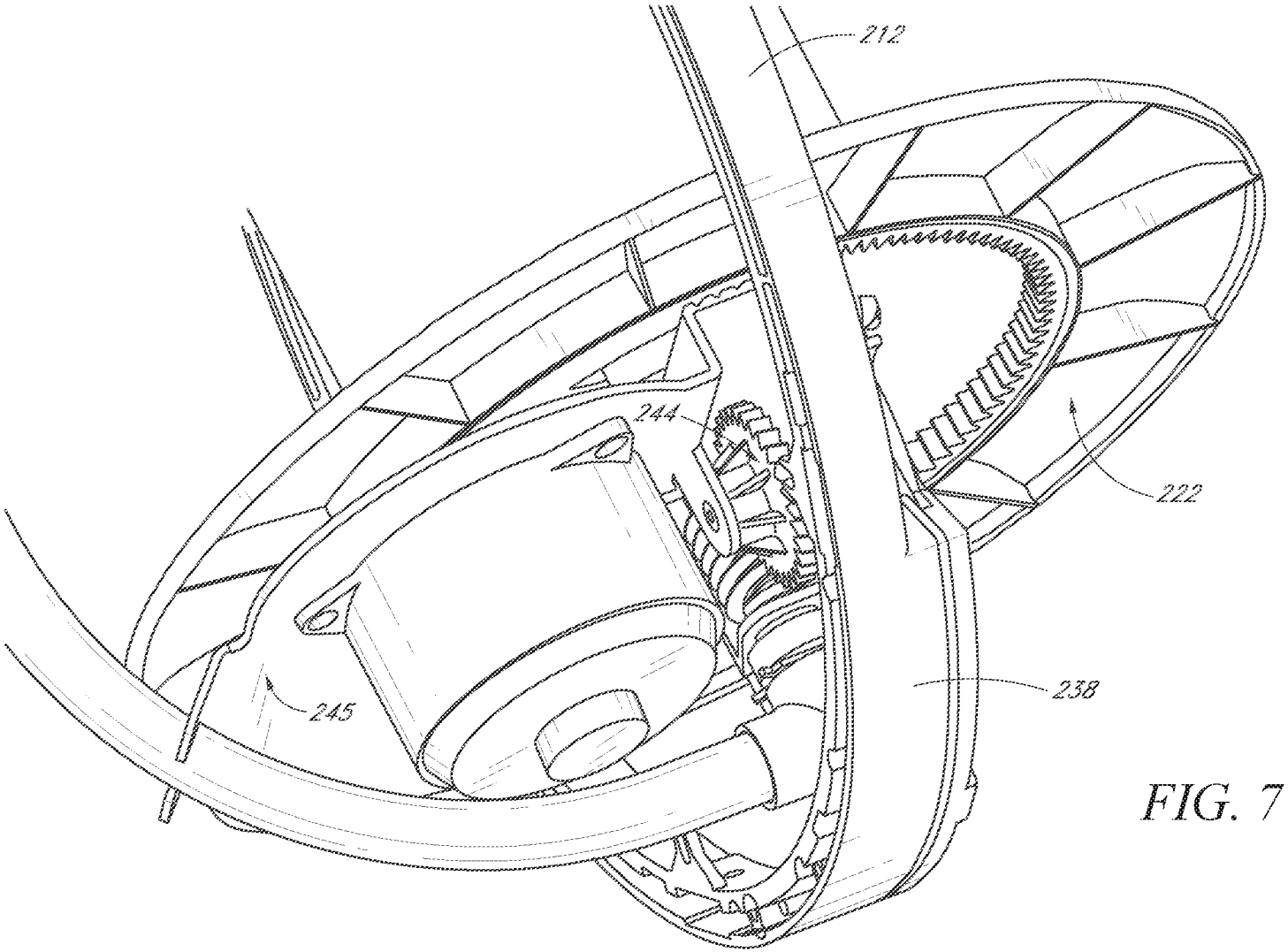
FIG. 7 is a bottom and side partially cut-away perspective view of reciprocating mechanism of FIG. 2.

As shown in FIGS. 2, 6 and 7, the worm gear section 242 preferably meshingly engages a top or driven gear 244 mounted on and below the support frame 245. As used herein, the "engagement" of two gears means that the teeth of one gear are engaged with the teeth of the other gear. The top gear 244 is in turn coupled to a lever 246 (see FIG. 5), for example, via a pin 246*a* (see FIG. 8B) that extends along an axis of rotation of the top gear 244. As shown in FIG. 5, the lever 246 defines an elongated slot 247 therein. In a preferred embodiment, the top gear 244 and lever 246 are lockingly coupled, so that rotation of the top gear 244 results in rotation of the lever 246. In another embodiment, the top gear 244 and lever 246 are integrally formed. The lever 246 is preferably coupled to an elongate member 248, so that a first end or portion 248*a* of the elongate member 248 extends through and is adapted to slidingly move along the slot 247, while a second end or portion 248*b* of the elongate member 248 is pivotably secured to the support member 238. In one embodiment, the first end 248*a* of the elongate member 248 extends completely through the slot 247 of the lever 246 and at least partially or completely through the slot 252 of the guide member 250 (described below). In another embodiment, the lever 246 is below the guide member 250, and the first end 248*a* of the elongate member 248 extends completely through the slot 252 and at least partially or completely through the slot 247 of the lever 246.

As best shown in FIG. 5, a guide member or track 250 is disposed adjacent the lever 246, so that the guide member 250 extends along a plane generally parallel to a plane within which the lever 246 rotates. In the illustrated embodiment, the guide member 250 defines an encircling slot 252. In the illustrated embodiment, the enclircling slot 252 extends only partially through the guide member 250, so as to define a groove or recess. In another embodiment, the encircling slot 252 can extend completely through the guide member 250. In the illustrated embodiment, the first end 248*a* of the elongate member 248 extends partially through and is adapted to move along the encircling slot 252 of the guide member 250, so that the elongate member 248 pivots about an axis generally perpendicular to the plane of the encircling slot 252. In another embodiment, the first end 248*a* of the elongate member 248 can extend completely through the encircling slot 252 of the guide member 150. In the illustrated embodiment, the guide member 250 is disposed between the support frame 245 and the lever 246 and is preferably secured to the support frame 245. However, in another embodiment, the lever 246 can be positioned between the support frame 245 and the guide member 250. As used herein, encircling means surrounding, but is not necessarily limited to a circular surrounding. In the illustrated embodiment, the guide member 250 is shaped somewhat in the form of a "D" (see FIG. 8A). However, the guide member 250 can have other suitable shapes, such as circular, oval, triangular and trapezoidal.

Figure 2A:
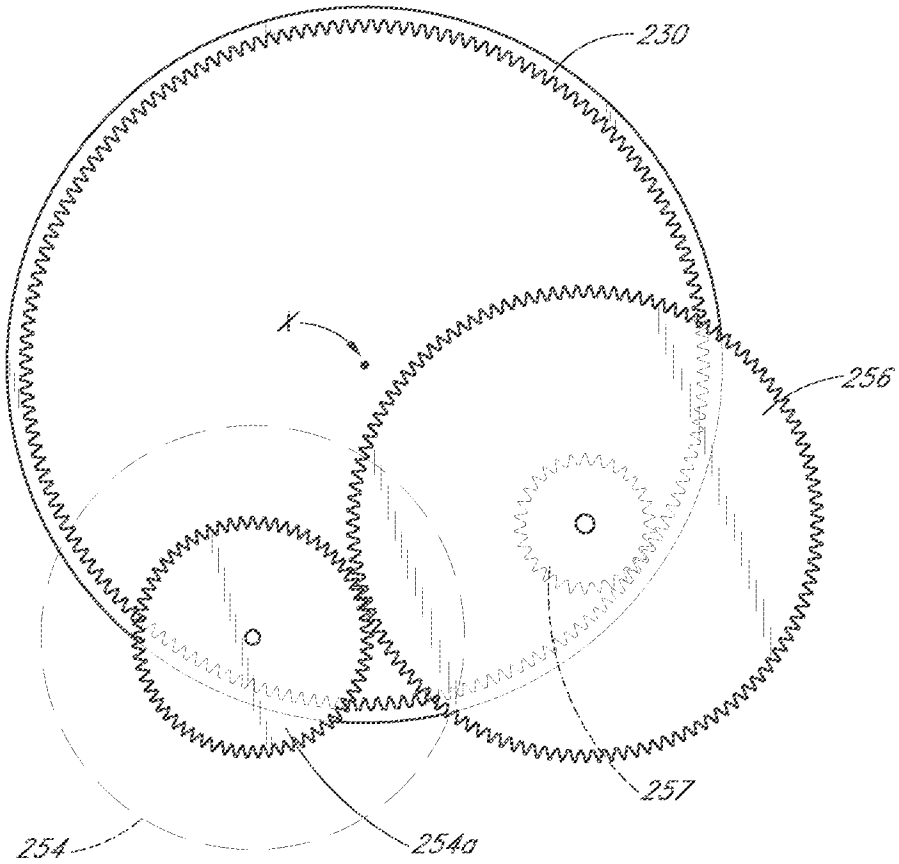
FIG. 2A is a schematic illustration of a gear reduction between a motor and a gear of the reciprocating mechanism shown in FIG. 2.

As shown, for example in FIG. 2, the reciprocating mechanism 200 includes a motor 254 mounted to the support frame 245. In the illustrated embodiment, the motor 254 is disposed below the lower ring 214 and is housed in the lower shell portion 24. Preferably, the motor 254 is an electric motor. The motor 254 preferably operatively connects to the ring gear 230 via a drive gear 256. For example, the motor 254 can, through a gear reduction comprising multiple gears, drive the drive gear 256, which can operatively drive the ring gear 230 at a desired speed. One example of a gear reduction is shown in FIG. 2A, which includes a motor gear 254*a* that meshingly engages and drives the drive gear 256. In the illustrated embodiment, another gear 257 (also shown in FIG. 6), which is preferably co-axial with the drive gear 256, meshingly engages and drives the ring gear 230. However, the gear reduction can include any number of gears and have other configurations for operatively coupling the motor 254 to the ring gear 230. Additionally, any desired gear ratio can be used. In one embodiment, the gear reduction has a gear ratio of 2 to 1. In another embodiment, the gear reduction has a gear ratio of 4 to 1. In still another embodiment, the gear reduction has a gear ratio of between about 2 to 1 and about 25 to 1. One example of a gear reduction between the motor 254 and the ring gear 230 is schematically shown in FIG. 2A.

The reel 100 can also employ an electronic motor controller and associated electronic componentry for controlling the speed and direction of the motor 254. For example, while spooling the linear material 268 (see FIG. 9A) onto the drum 226, a motor-controller can be employed to vary the motor speed based upon the length of unwound linear material 268. It will be appreciated that if the motor speed is constant, the inwardly pulled linear material 268 tends to move increasingly faster due to the increasing diameter of the spool itself. A motor-controller can adjust the motor speed to more safely control the motion of the linear material 268 during spooling. Also, a motor-controller can be used to slow or stop the motor 254 just before the linear material 268 becomes completely spooled onto the drum 226. Otherwise, the linear material 268 would get pulled into the housing or, if there is an object at the end of the linear material 268 (e.g., a nozzle), the object may whip against or otherwise impact the housing or a person near the housing. In addition, a motor-controller can even be used to assist the user during unspooling of the linear material 268 (i.e., powered unspooling). One example of a motor-controller for a reel is disclosed in U.S. Pat. No. 7,350,736 to Caamaño et al., entitled Systems and Methods for Controlling Spooling of Linear Material, the entire contents of which are hereby incorporated by reference and should be considered a part of this specification. Also, the motor 254 and/or motor-controller can be operated via a remote control. An exemplary remote control system for a motorized reel is disclosed in U.S. Pat. No. 7,503,338 to Harrington et al., the entire contents of which are hereby incorporated by reference and should be considered a part of this specification. In a preferred embodiment, a remote control is engaged on the spooled linear material 268 at or near its outward end. The remote control can send signals wirelessly (e.g., via radio frequency signals) or through a wire within the linear material.

Figure 4:
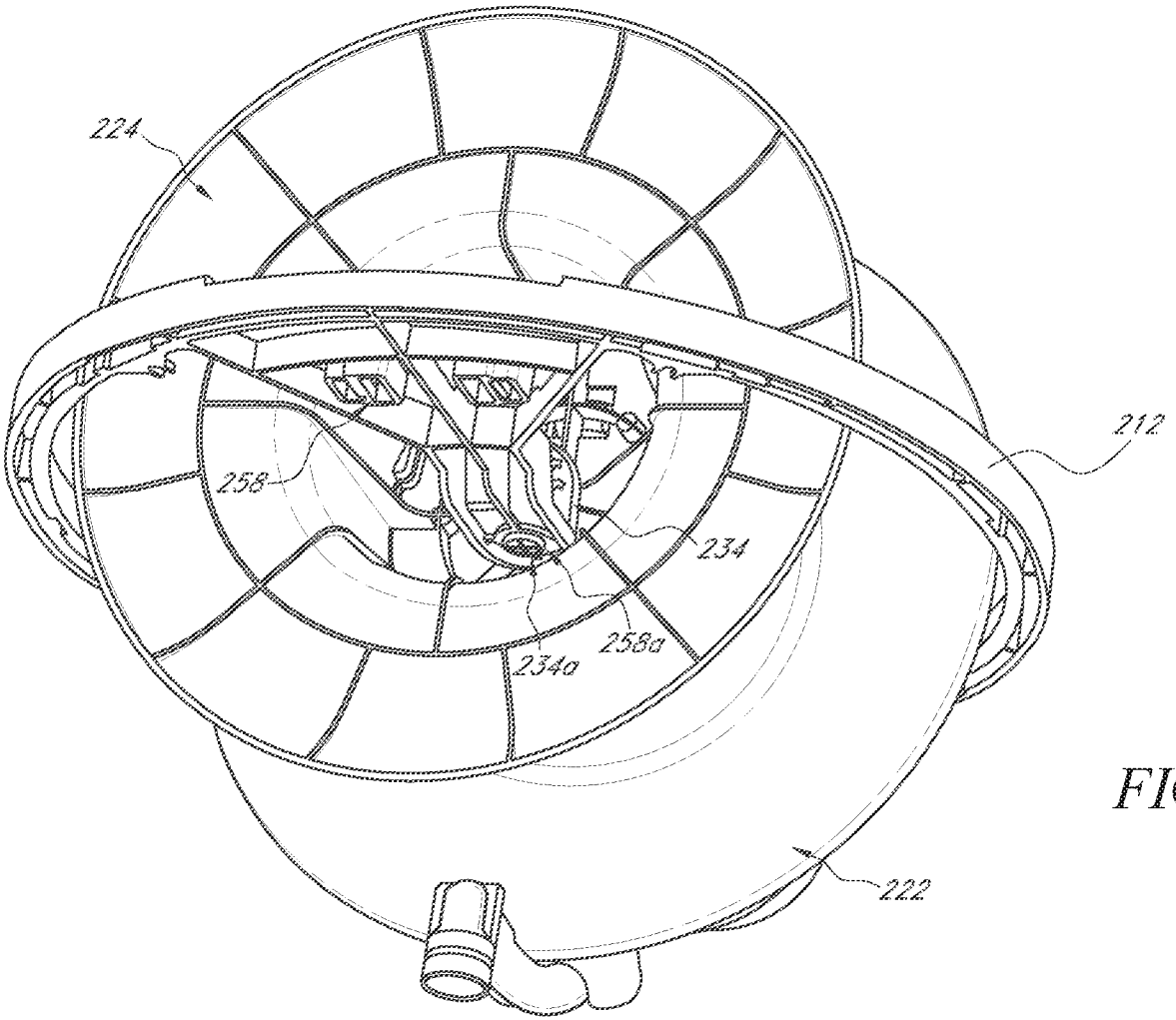
FIG. 4 is bottom and side perspective view of the drum assembly in FIG. 3.
Figure 8A:
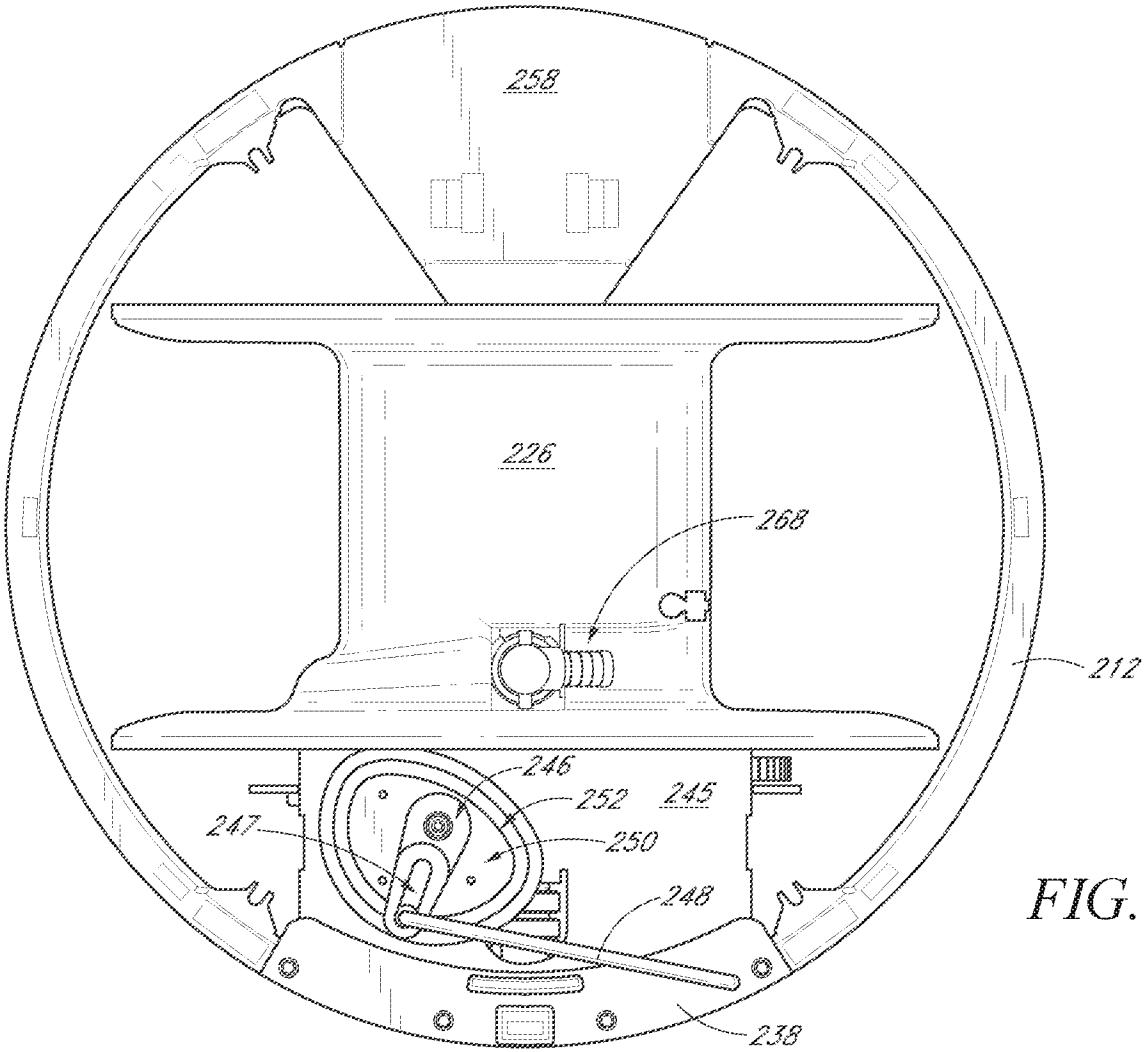
FIG. 8A is a top view of the drum assembly of FIG. 2 illustrating one position in the reciprocating rotation of the drum.
Figure 8B:
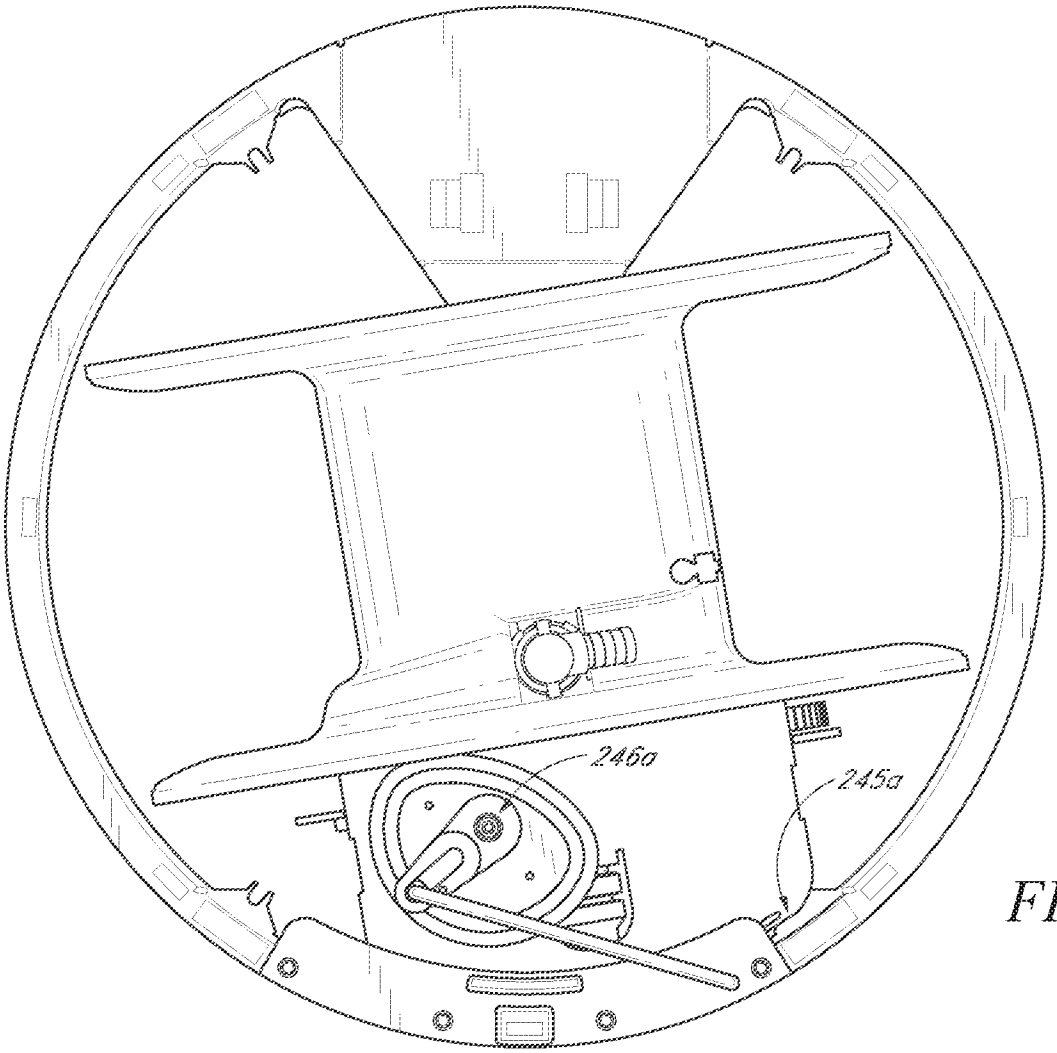
FIG. 8B is a top view of the drum assembly of FIG. 2 illustrating another position in the reciprocating rotation of the drum.
Figure 8C:
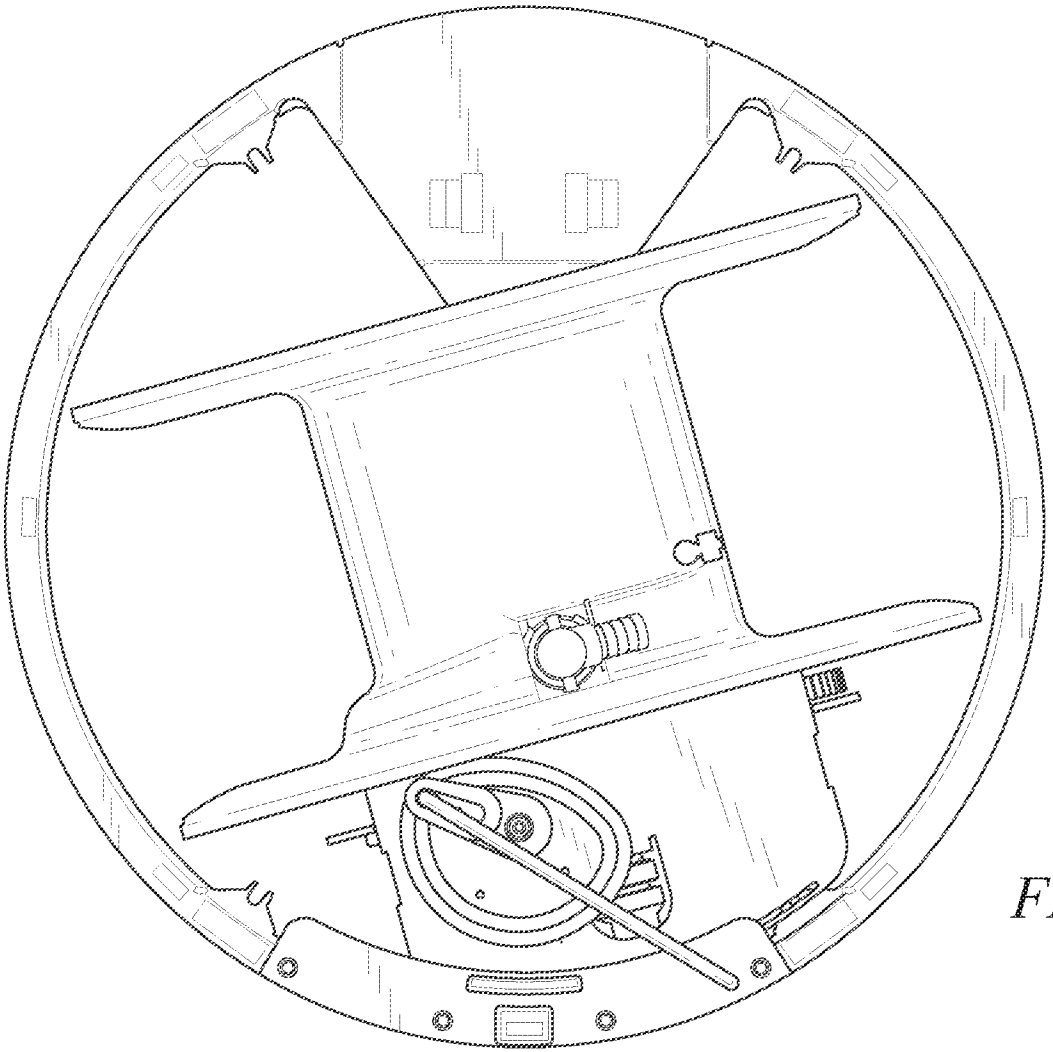
FIG. 8C is a top view of the drum assembly of FIG. 2 illustrating another position in the reciprocating rotation of the drum.
Figure 8D:
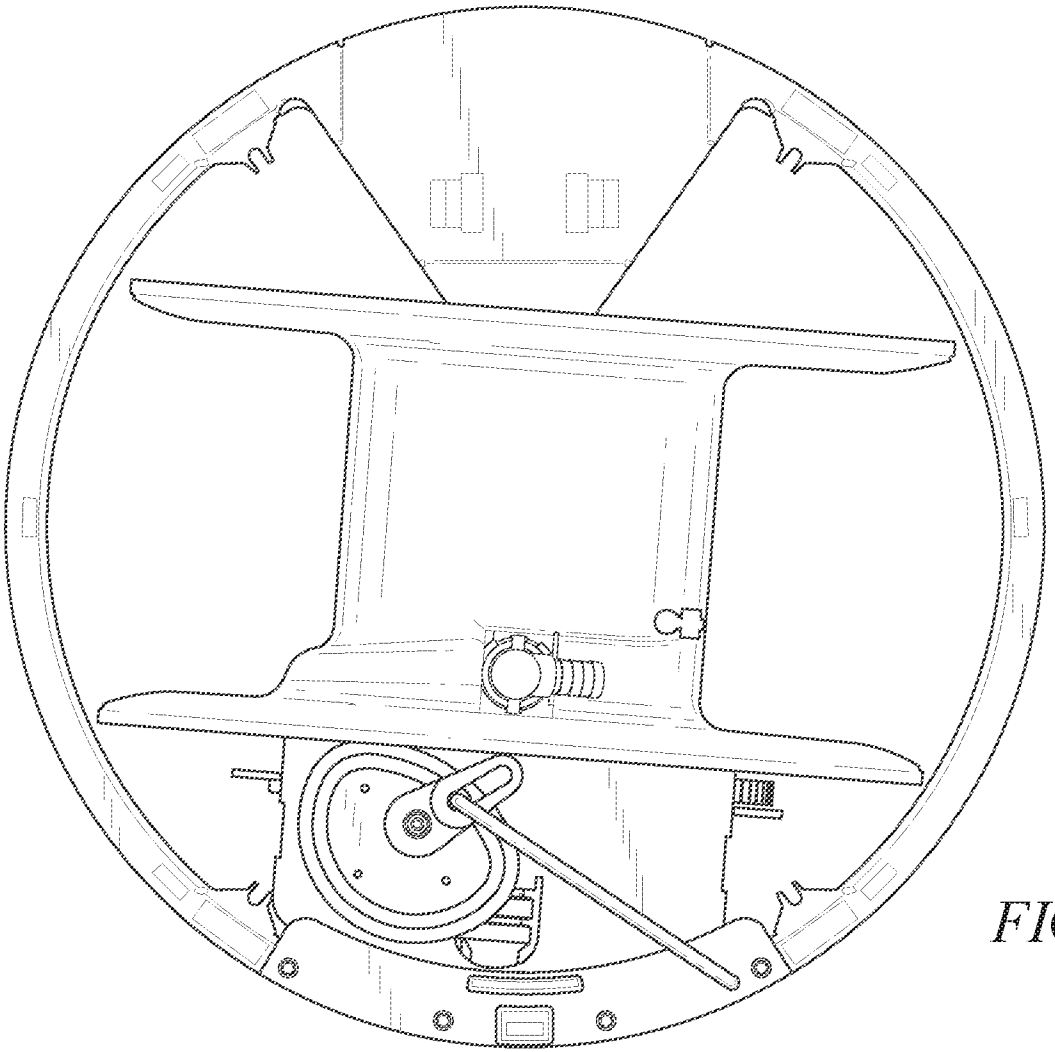
FIG. 8D is a top view of the drum assembly of FIG. 2 illustrating another position in the reciprocating rotation of the drum.
Figure 8E:
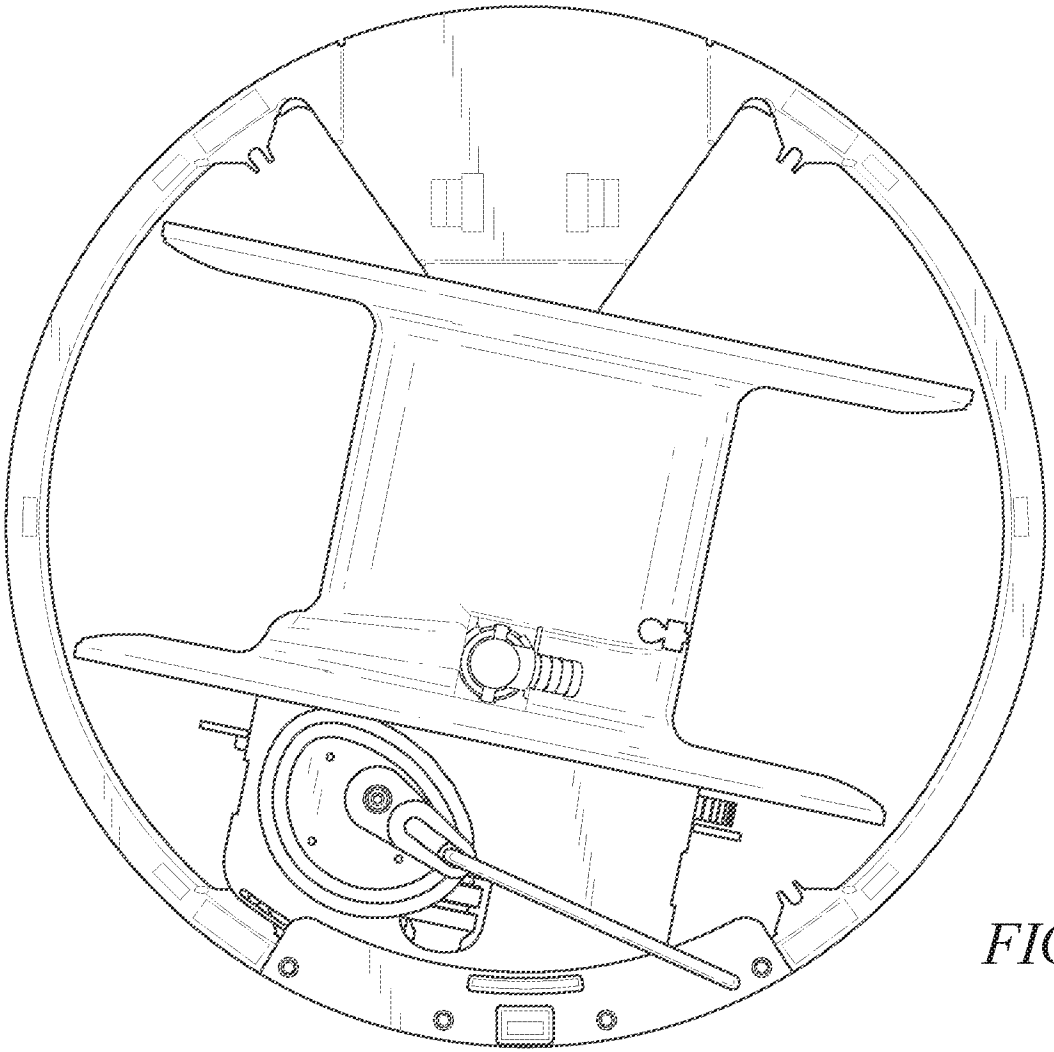
FIG. 8E is a top view of the drum assembly of FIG. 2 illustrating another position in the reciprocating rotation of the drum.

As shown in FIGS. 3-4, the reciprocating mechanism 200 also has a platform 258 that extends between the shaft support 234 and the edge of the upper ring 212. As shown in FIG. 8A, the platform 258 is disposed generally opposite the upper ring support member 238. The platform 258 preferably extends into the hollow portion 228 of the drum 226. In one embodiment, the platform 258 can support a battery (not shown) thereon so that the battery is disposed between the second endplate 224 and the upper ring 212. Preferably, the battery provides power to the motor 254. Details of one suitable battery for use with the reciprocating mechanism 200 can be found in U.S. Pat. No. 7,320,843 to Harrington, entitled Battery Assembly With Shielded Terminals, the entire contents of which are hereby incorporated by reference and should be considered a part of this specification.

As shown in FIGS. 3 and 4, the platform 258 preferably supports the shaft support 234 thereon. In the illustrated embodiment, a pin 234*a* of the shaft support 234 pivotably extends through an opening 258*a* of the platform 258, permitting the shaft support 234 to rotate with respect to the platform 258 about a vertical axis extending through the opening 258*a*. This pivot connection advantageously allows the reciprocating mechanism 200 to reciprocatingly rotate the drum 226 about the shell axis Y, as further discussed below.

As discussed above, the fitting 236 couples to the conduit member 262. In one embodiment, the second end 266 of the conduit 262 is configured to removably attach to a water hose (not shown). For example, the second end 266 can have a threaded surface for threaded engagement with a corresponding thread on the hose (e.g., a standard hose fitting). In another embodiment, the second end 266 can have a quick-disconnect portion configured to removably engage a corresponding quick-disconnect portion on the hose. Other mechanisms for connecting the hose and the conduit 262 are also possible. Preferably, water provided through the hose flows through the conduit 262 and through the fitting 236 and shaft 232 into the shaft support 234. In one preferred embodiment, the shaft support 234 communicates, for example, via a second conduit (not shown), with a second fitting 268 (see FIGS. 2 and 8A) disposed on the surface of the drum 226. In this manner, water can be supplied to a hose that has been spooled on the drum 226 and has been removably fastened to the second fitting 268. Any suitable mechanism for removably fastening the hose and the second fitting 268 can be used, such as a threaded engagement or a quick-disconnect connection. Further details on such an arrangement is shown, for example, in U.S. Pat. No. 6,981,670 to Harrington, entitled Reel Having Apparatus for Improved Connection of Linear Material, the entire contents of which are hereby incorporated by reference and should be considered a part of this specification.

In another embodiment, the second end 266 of the conduit 262 can removably attach to a pressurized air source (e.g., a compressor). For example, the second end 266 can have a threaded surface for threaded engagement with a corresponding thread on a hose or other connector of the pressurized air source (e.g., a compressor). In another embodiment, the second end 266 can have a quick-disconnect portion that can removably engage a corresponding quick-disconnect portion on the hose or other connector of the pressurized air source (e.g., compressor). Other mechanisms for connecting the hose and the conduit 262 are also possible. Preferably, air provided by the pressurized air source (e.g., compressor) flows through the conduit 262 and through the fitting 236 and shaft 232 into the shaft support 234. In one preferred embodiment, the shaft support 234 communicates, for example, via a second conduit (not shown), with a second fitting 268 (see FIGS. 2 and 8A) disposed on the surface of the drum 226. In this manner, air can be supplied to a hose 268B, 268A (see FIG. 15) that has been spooled on the drum 226 and has been removably fastened to the second fitting 268.

The rings 212, 214 and gears 230, 242, 244, 256 of the reciprocating mechanism 200 are preferably made of a strong material resistant to breaking. In one embodiment, the rings 212, 214 and gears, 230, 242, 244, 256 can be made of a metal or metal alloy, such as stainless steel and aluminum. However, other materials can also be used. In another embodiment, the rings 212, 214 and gears 230, 242, 244, 256 of the reciprocating mechanism 200 can be made of a hard plastic. In still another embodiment, the gears 230, 242, 244, 256 may be formed of acetyl, such as Delrin® sold by Dupont, headquartered in Wilmington, Del. Various combinations of these materials are also possible.

The use of the reciprocating mechanism 200 to reciprocatingly rotate the drum assembly 220 is illustrated in FIGS. 8A-8E. Actuation of the motor 254 preferably rotates the ring gear 230 in one direction via the drive gear 256 and, optionally, a gear reduction assembly (see e.g., FIG. 2A) operatingly coupling the motor 254 to the drive gear 256. Rotation of the ring gear 230 in turn rotates the reel drum 226 via the first endplate 222. Rotation of the ring gear 230 also rotates the shaft 232 in the same direction, causing the worm gear section 242 to also rotate. Rotation of the worm gear section 242 rotates the top or driven gear 244, which in turn rotates the lever 246 about the axis of the top gear 244. As the lever 246 rotates, it guides the first end 248*a* of the elongate member 248 about the axis of the top gear 244 and along the encircling slot 252 of the guide member 250, thus moving the elongate member back and forth. As the lever 246 rotates and guides the first end 248*a* of the elongate member 248 about the axis of the top gear 244, the first end 248*a* also slides along the slot 247 of the lever 246. The movement of the elongate member 248 in turn reciprocatingly rotates the drum 226 relative to the upper ring 212 about the shell axis Y via the pivot connection 234*a*, 258*a* between the shaft support 234 and the platform 258. In one embodiment (e.g., if the slot 252 is circular), the reciprocating mechanism 200 reciprocatingly rotates the drum 226 so that an angular velocity of the drum about the shell axis Y fluctuates generally sinusoidally.

In a preferred embodiment, the slot 247 on the lever 246 and the encircling slot 252 on the guide member 250 allow the drum 226 to reciprocate about the shell axis Y at a generally constant angular velocity between endpoints of the reciprocation for a given drum 226 rotation speed about the drum axis X. It is the general D-shape of the slot 252 that produces this outcome. It will be appreciated that other sizes and shapes of the slot 252, slot 247, lever 246, and elongate member 248 can achieve the goal of a generally constant angular velocity between endpoints of the reciprocation.

Figure 9A:
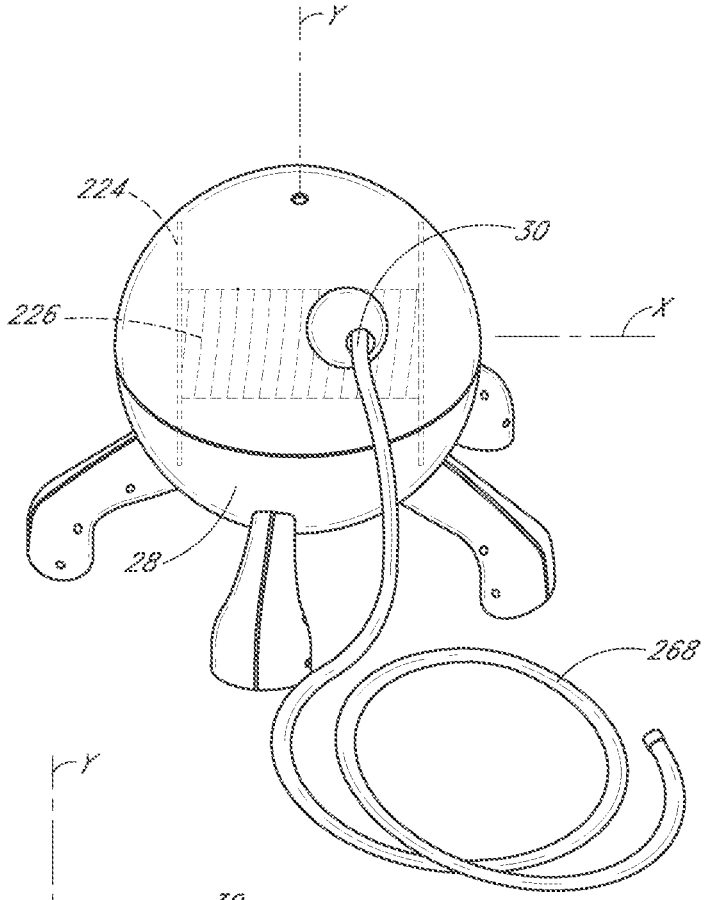
FIG. 9A is a top and front perspective view of the reel assembly of FIG. 1 illustrating one position in the reciprocating rotation of the drum.
Figure 9B:
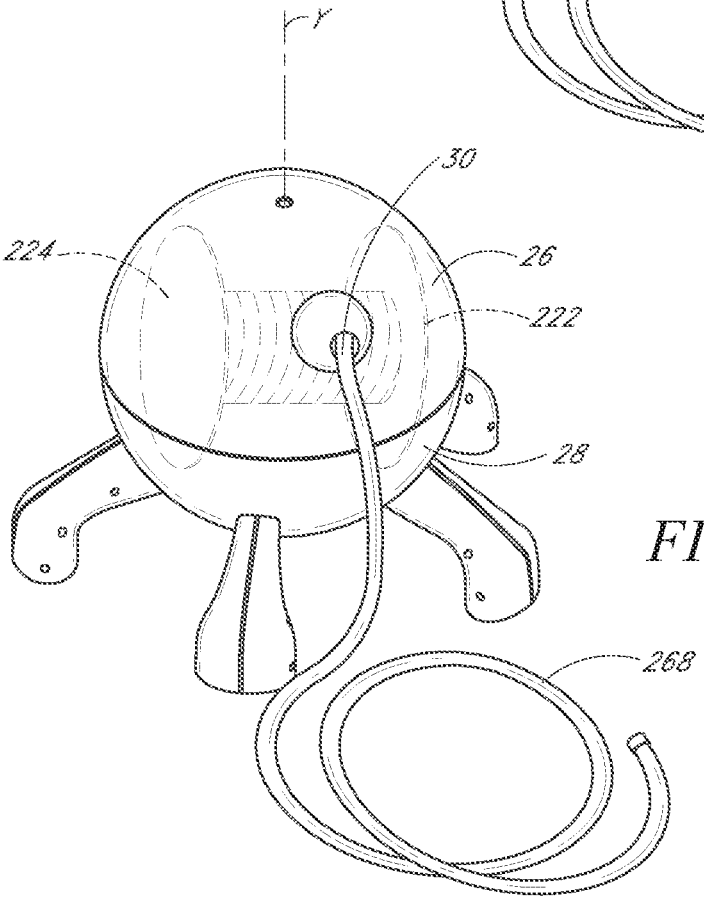
FIG. 9B is a top and front perspective view of the reel assembly of FIG. 1 illustrating another position in the reciprocating rotation of the drum.

In one embodiment, the upper shell portion 22, which is preferably fixed with respect to the upper ring 212, and the aperture guide 30 in the upper shell portion 22, remain in a fixed position while the drum 226 reciprocatingly rotates inside the housing to spool and unspool the linear material 268, as shown in FIGS. 9A-9B. In another embodiment, the reciprocating mechanism 200 reciprocatingly rotates the upper shell portion 22 about the shell axis Y, while the drum 226 is preferably in a substantially fixed angular position.

The substantially constant angular velocity of the drum 226 about the shell axis Y that is generated by the reciprocating mechanism 200 advantageously allows the spooling and unspooling of linear material onto the drum 226 with increased efficiency. Such increased efficiency allows the use of a drum 226 having a smaller width to spool the same amount of linear material, requires less power to spool the same amount of linear material, and allows for an overall reduction in the size of the reel assembly 100. The reciprocating mechanism 200 according the embodiments discussed above also advantageously require about 30% less parts to operate than conventional reciprocating mechanisms.

Figure 10:
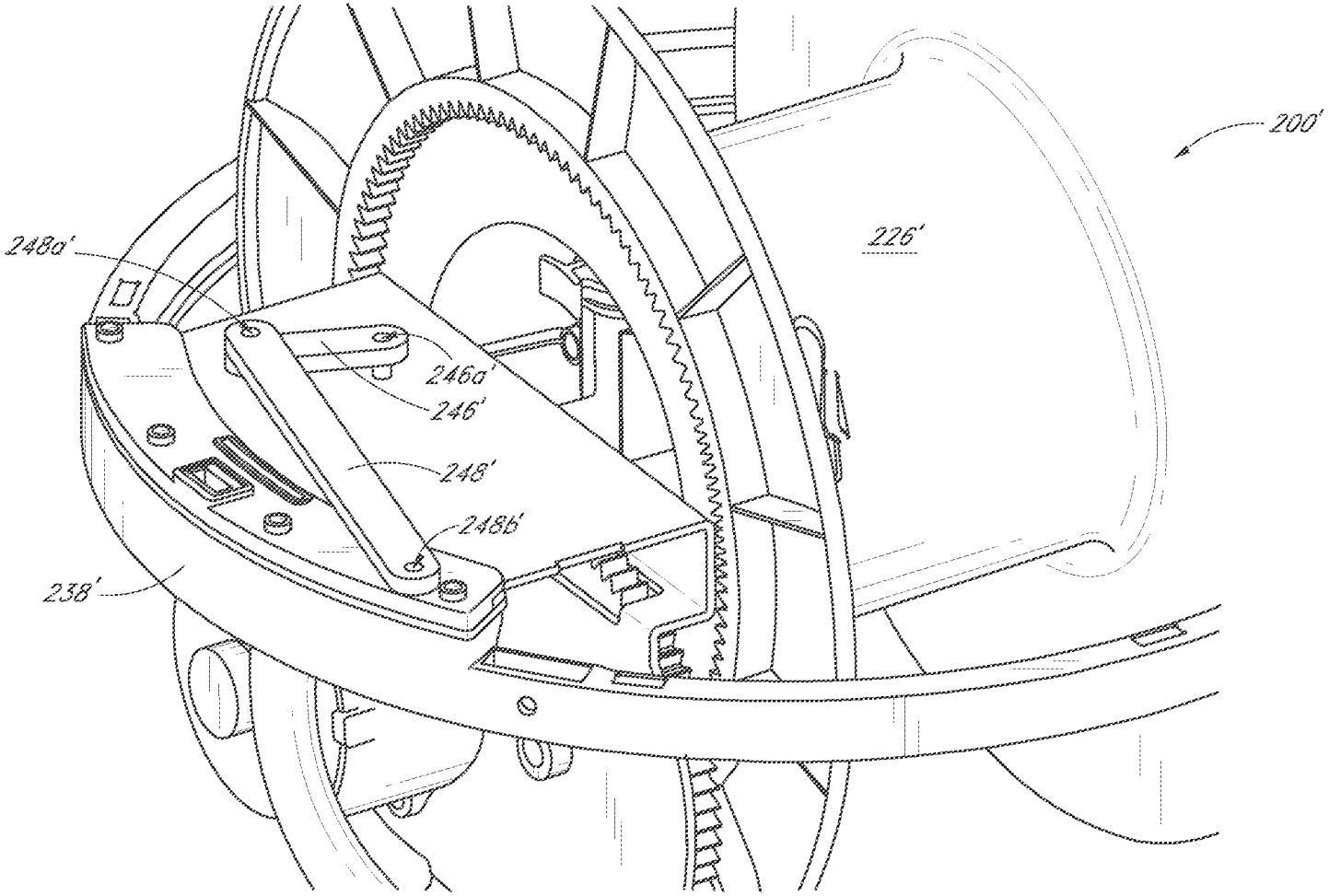
FIG. 10 is a top partially cut-away perspective view of another embodiment of a reciprocating mechanism.

FIG. 10 illustrates another embodiment of a reciprocating mechanism 200'. The reciprocating mechanism 200' is similar to the reciprocating mechanism 200, except as noted below. Thus, the reference numerals used to designate the various components of the reciprocating mechanism 200' are identical to those used for identifying the corresponding components of the reciprocating mechanism 200 in FIG. 5, except that a "'" has been added to the reference numerals.

The reciprocating mechanism 200' includes a top or driven gear coupled to a lever 246' via a pin 246*a*' that extends along the axis of the top gear. The top gear and the lever 246' are preferably lockingly coupled, so that rotation of the top gear about the top gear axis results in rotation of the lever 246' in the same direction. In another embodiment, the top gear and the lever 246' can be integrally formed. The lever 246' is preferably pivotably coupled to an elongate member 248' at a first pivot point 248*a*'. The elongate member 248' is also pivotably secured to a support member 238' at a second pivot point 248*b*'. The relative motion between the lever 246' and the elongate member 248' advantageously generates a reciprocating motion of the drum 226' about a drum axis.

In a preferred embodiment, the gear ratio of the gear reduction and size of the ring gear 230, worm gear 242, drive gear 256, and top gear 244, as well as the lengths of the levers 246 and elongate member 248, are selected to reciprocatingly rotate the drum 226 relative to the upper ring 212 about the shell axis Y so as to cause a linear material to be generally uniformly wound onto the reel drum. Thus, the reciprocating mechanism 200 advantageously allows a linear material to be uniformly wound onto the drum 226.

As discussed above, the upper ring 212 and drum assembly 220 preferably rotate freely relative to the lower ring 214, preferably through 360 degrees and more, as desired. Therefore, the upper shell portion 22 coupled to the upper ring 212 can advantageously rotate freely relative to the lower shell portion 24, which is preferably fixed with respect to the lower ring 214.

Figure 11:
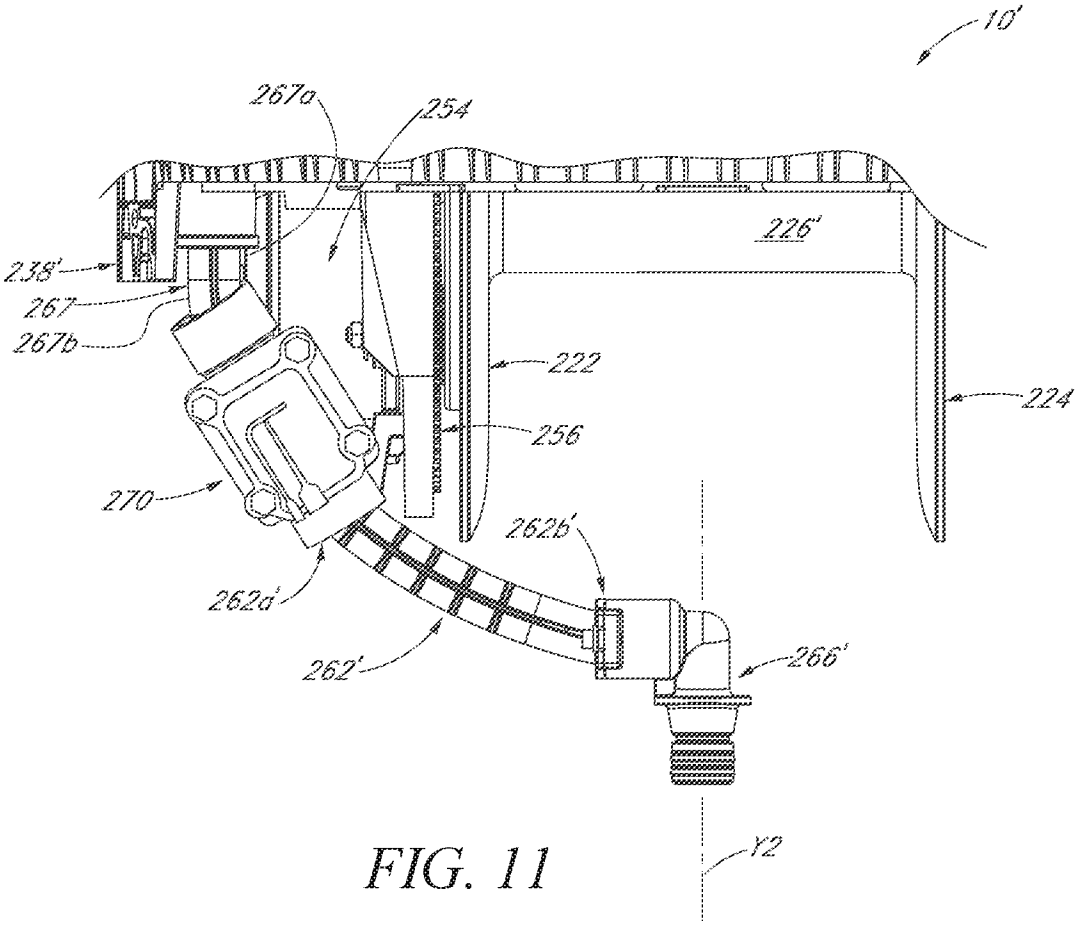
FIG. 11 shows a partial bottom view of another embodiment of a drum assembly.
Figure 12:
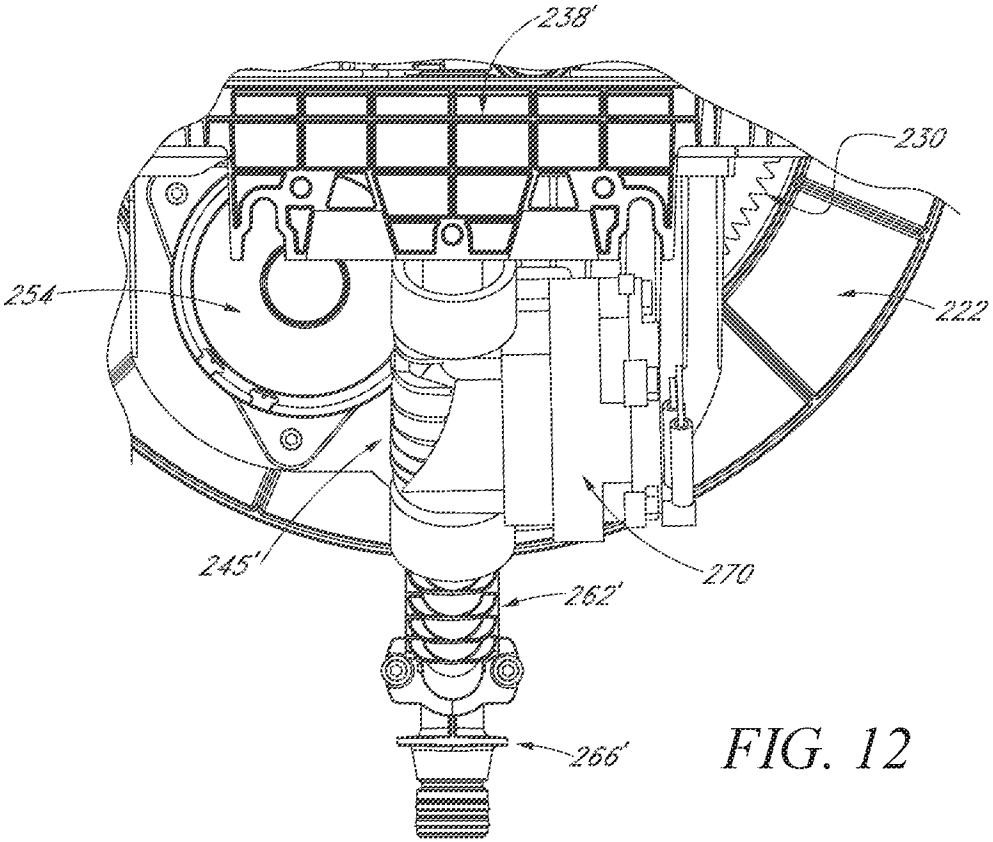
FIG. 12 shows a partial bottom view of the drum assembly of FIG. 11, rotated 90 degrees.
Figure 13:
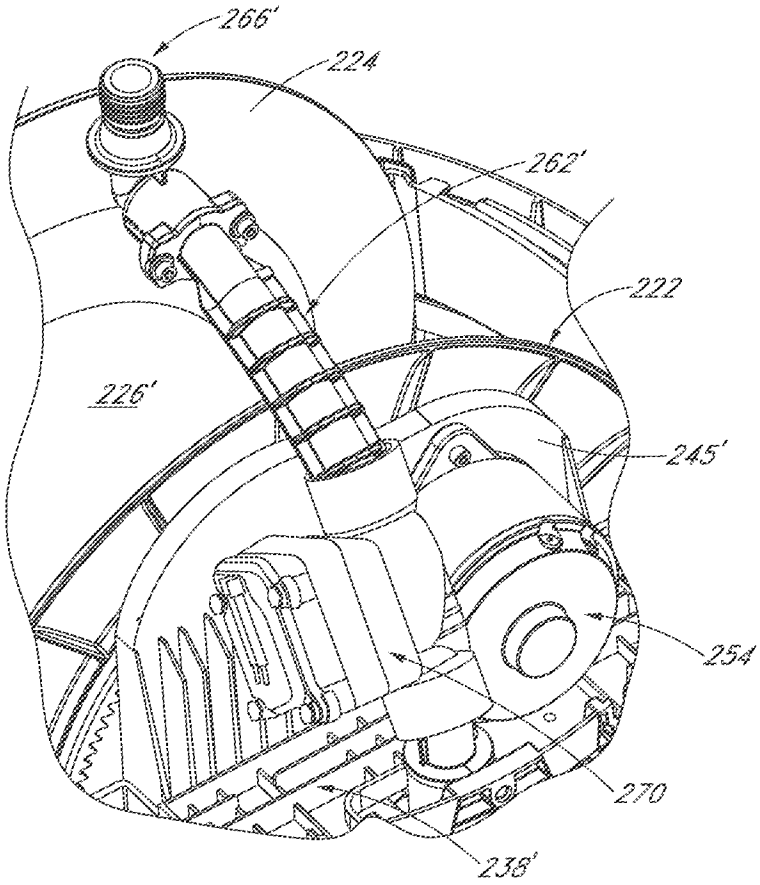
FIG. 13 shows a partial perspective bottom view of the drum assembly of FIG. 11.

FIGS. 11-13 show another embodiment of a drum assembly 10'. The drum assembly 10' is similar to the drum assembly 10 in FIGS. 2-7 and includes all of the components of the drum assembly 10 in FIGS. 2-7, except as noted below. Thus, the reference numerals used to designate the various components of the drum assembly 10' are identical to those used for identifying the corresponding components of the drum assembly 10 in FIGS. 2-7 and described above, except that a "'" has been added to the reference numerals.

With reference to FIGS. 11-13, a flow control valve 270 is attached to the ring support member 238'. The flow control valve 270 is fluidly coupled to a proximal end 262*a*' of a conduit member 262' and to a distal end 267*b* of a conduit section 267. A distal end 262*b*' of the conduit member 262' is coupled to the conduit end portion 266' (that extends along the axis Y2). In one embodiment, the conduit member 262' and conduit end portion 266' are a single piece. The conduit section 267 has a proximal end 267*a* that can be in fluid communication with a hose fitting (not shown) on the drum 226' to which a hose can be attached, the hose being wound and unwound about the drum. The conduit end portion 266' can be coupled to a fluid source for providing a fluid flow from the fluid source, through the conduit end portion 266', through the conduit member 262', through the flow control valve 270, through the conduit section 267 and through the hose fitting into the hose. The conduit member 262' can be rigid or semi-rigid and be made of a hard plastic or other suitable material (e.g., metal). In the illustrated embodiment, the conduit member 262'can be curved and have a curvature that generally corresponds to an inner curvature of one of the upper and lower shell portions 22, 24 of the housing of the reel assembly 100 that defines a space into which the conduit member 262' extends.

Figure 14:
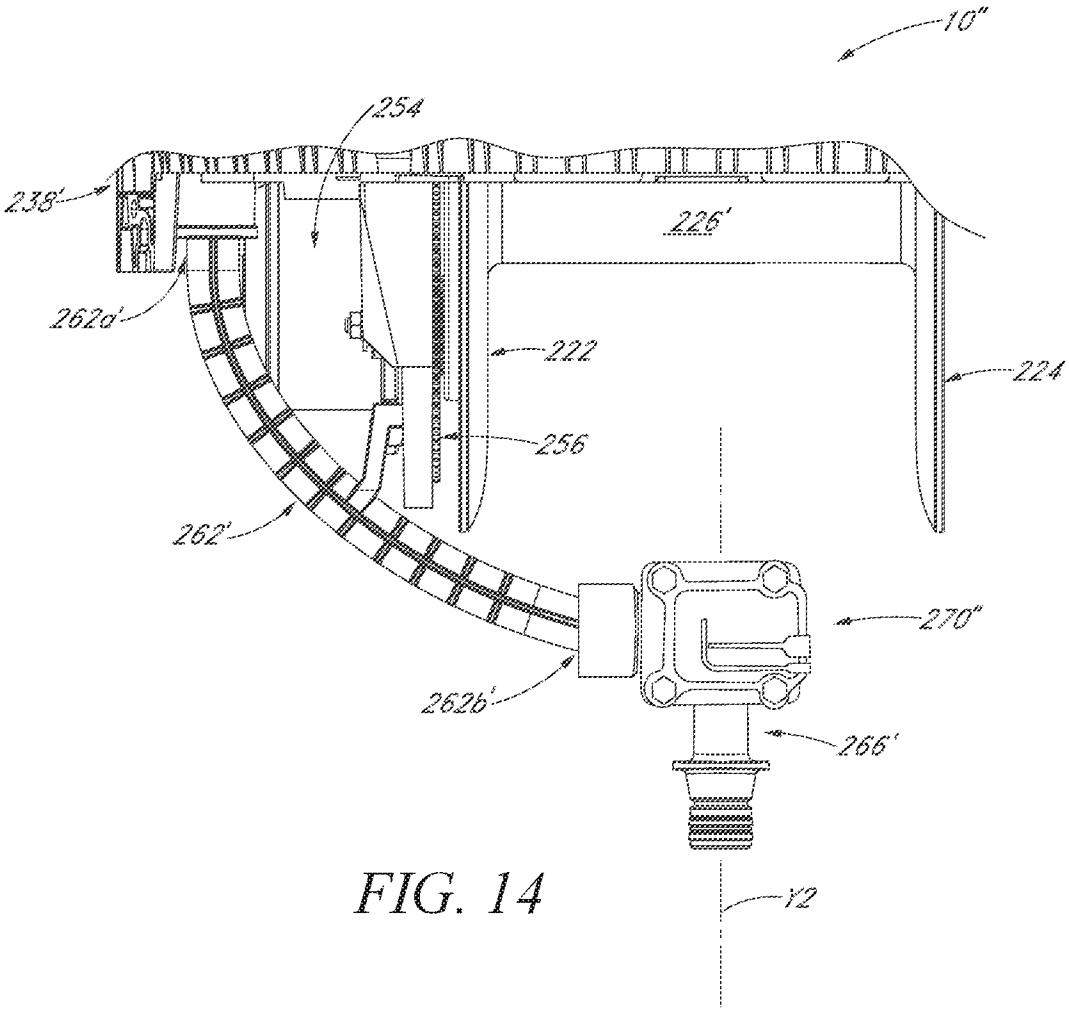
FIG. 14 shows a partial bottom view of another embodiment of a drum assembly.

FIG. 14 shows another embodiment of a drum assembly 10". The drum assembly 10" is similar to the drum assembly 10' in FIGS. 11-13, except as noted below. Thus, the reference numerals used to designate the various components of the drum assembly 10" are identical to those used for identifying the corresponding components of the drum assembly 10' in FIGS. 11-13, except that a "'" has been added to the reference numerals. With reference to FIG. 14, the flow control valve 270" can be disposed between the distal end 262*b*' of the conduit member 262' and the conduit end portion 266'. In still another embodiment, the flow control valve 270" can be disposed at the distal end 262*b*' of the conduit member 262' and the drum assembly 10" can exclude the conduit end portion 266'. Advantageously, mounting the flow control valve 270, 270" on the drum assembly 10', 10" allows for all components to be housed in a housing of the reel.

In one embodiment, the flow control valve 270" can be mounted on a bottom portion (e.g. removable skid plate) of the lower dome 28, which in one embodiment can be removably attached to the rest of the lower dome 28 to advantageously facilitate access to the flow control valve 270" (e.g., to perform maintenance on the valve 270" or replace the valve 270") without having to detach the upper dome 26 from the lower dome 28. The skid plate can be a circular portion (or other shaped circumference, such as square, oval, triangular) of the lower dome portion 28 that is removably attached to the rest of the lower dome portion 28 by one or more fasteners (e.g., screws or bolts), and that has an opening through which at least a connection portion of the conduit end portion 266' extends, thereby allowing a water source to be fluidly coupled to the conduit end portion 266'. In one embodiment, the flow control valve 270" can be mounted to the bottom portion of the lower dome 28 via one or more bearings and/or via a slip ring that allows rotation of the bottom portion (e.g., removable skid plate, slip ring) relative to the rest of the bottom dome 28, to thereby allow rotation of the flow control valve 270" about the axis Y2, as discussed above. In one embodiment, the one or more bearings can be interposed between the bottom portion and the rest of the bottom dome 28 (e.g., radially interposed between an outer edge of the bottom portion and an inner edge of the opening in the lower dome 28 that movably coupleably receives the bottom portion) to allow relative rotation between the bottom portion and the rest of the dome 28.

Additionally, mounting the flow control valve 270, 270" on the drum assembly 10', 10" advantageously allows the valve 270, 270" to be powered by the power source (e.g., battery) that powers other components (e.g., motor 254', controller) of the reel, so that the flow control valve 270, 270" need not have its own separate power source, thereby simplifying the construction of the reel and providing for more efficient operation of the reel. In one embodiment, the controller can be mounted on the ring support member 238' and/or the support frame 245, 245' or platform 258.

The valve 270, 270" can be an electrically actuated valve, such as a solenoid valve, and selectively permit or inhibit fluid flow therethrough. The valve 270, 270" can be electrically connected to a controller (not shown) of the reel assembly (e.g., the valve can be hardwired to the controller), and can be powered by a battery (not shown) that powers the reel assembly. Accordingly, the electrically actuated valve 270, 270" need not have its own power source.

The controller can have a wireless receiver configured to receive electromagnetic signals from a remote source (e.g., a remote control, such as remote control attached to the hose), and to translate those signals into signals that may open or close the electrically actuated valve 270, 270". In one embodiment, the flow control valve 270, 270" can be controlled wirelessly (e.g., with a remote control) as discussed above. In another embodiment, the flow control valve 270, 270" can be hard-wired to the controller. Additionally, the controller that controls the operation of the valve 270, 270" can be electrically connected to the motor 254' that drives rotation of a reel drum 226'. Thus, the controller can send signals to control the operation of the motor 254' for the reel, the motor command signals being conveyed to the motor via the wire connection. The wire connection can also convey power to one or both of the flow control valve 270, 270" and the motor 254'. In one embodiment, the motor 254' can be powered by connection of an electrical plug to a power supply, the wire connection conveying power to the flow control valve 270, 270". Examples of communication methods include infrared (IR) and radio frequency (RF) communications.

Winding in Strain Relief

It is desirable for some embodiments of the reel assembly 100 (e.g., automatic reel device) to prevent all of the linear material 268 from being unwound from the assembly 100 and to instead ensure that at least a portion of the linear material 268 remains wound around the rotatable spool member or drum assembly 220 within the reel assembly 100, which can reduce strain on the linear material 268 and help maintain the integrity of the linear material 268 as the linear material 268 is unwound from the spool member or drum assembly 220. Preventing all of the linear material 268 from being unwound may also reduce strain on and help maintain the integrity of connecting components between the linear material 268 and the spool member 220, as discussed in U.S. application Ser. No. 13/724,476, filed Dec. 21, 2012, the entire contents of which are hereby incorporated by reference and should be considered a part of this specification.

In certain embodiments, the controller determines the number of revolutions of the spool member 220 in the unspooling direction by, for example, counting the number of revolutions of the spool member 220 (e.g., using sensors, such as Hall effect sensors), so that the length of linear material 268 extracted from the assembly 100 is known. This value is compared to the known total length (i.e., total unspooled length) of the linear material 268 or to a predetermined value for the maximum length of linear material 268 to allow to be deployed. When that value is reached (e.g., strain relief portion), a braking mechanism is activated. In some embodiments, the duty cycle of the brake is gradually increased as that maximum deployable length is approached so that the user does not experience a sudden imposing of the brake. For example, at a first threshold, such as with 10 feet remaining before the maximum length is reached, the brake is engaged at a first duty cycle, such as 60%. As the amount of remaining length drops, the brake's duty cycle can be increased. In some embodiments, the brake is fully engaged when the maximum deployable length is reached; in some embodiments, the brake may operate at a relatively high duty cycle of, for example, approximately 90% or higher. In some embodiments, the motor 254 is engaged (without any power) when the strain relief portion is reached, and the motor 254 acts as a brake within the automatic reel assembly 100 to inhibit rotation of the rotatable member or spool member 220 while in the strain relief portion. As discussed above, in some embodiments, the winding operation may be initiated when the user pulls on the linear material by an amount coinciding with at least about 20 ticks of the Hall Effect sensors. However, when the full amount of deployable linear material has been paid out so that the automatic reel assembly 100 is in the strain relief position, the controller can initiate the winding operation of the linear material 268 upon detecting that the linear material 268 has been pulled by an amount corresponding to a lower number of counts or ticks of the Hall Effect sensors than when the automatic reel assembly 100 is not in the strain relief position (e.g., where all of the linear material 268 except for the strain relief portion has been deployed). For example, in some embodiments, when the automatic reel assembly 100 is in the strain relief position, a winding operation can be triggered by the user pulling on the linear material by an amount corresponding to about four ticks or counts of the Hall Effect sensors. However, the trigger number of ticks/counts to initiate the winding operation can be lower or higher than this.

In some embodiments, the strain relief point can be set when a user fully extracts the linear material 268 from the spooling member 220. The "flex" in the linear material 268 can cause the spooling member to rotate in an opposite direction than the direction of rotation during extraction (from winding out to winding in) as the linear material 268 is extracted to its full length. The Hall Effect sensors can sense the change in direction and set the number of counts (counting the number of revolutions of the spool member 220) that correspond to the length of the linear material 268 at full extraction (by sensing the change in rotation direction). Based on the number of counts, the controller can set the strain relief portion as discussed herein. In some embodiments, the strain relief portion is reset when a new docking point is set as discussed herein.

The length of linear material deployed from the rotatable or spool member 220 is determinable from the number of revolutions of the spool member 220 and the diameter of the potentially multi-layer spool of linear material 268 on the spool member 220. Thus, as the linear material 268 is deployed, the controller is able to determine when a sufficient length of linear material 268 is deployed such that only the proximal end portion (e.g., the last 15 feet) of the linear material 268 remains spooled about the spool member (e.g., the strain relief section of the linear material 268). When the controller makes this determination, the controller can reduce the duty cycle of the PWM (pulse-width modulation) pulses to reduce the rotational velocity of the motor 254, preferably to zero. In some embodiments, the controller also activates the brake, as discussed in the previous paragraph.

In some embodiments, lengths other than approximately fifteen feet may be retained as undeployable, such as for example, about 1, 2, 3, 4, 5, 6, 7, 8, 9, 10, 11, 12, 13, 14, or more than 15 feet. For example, the particular length may be set and/or adjustable by the user through, e.g., the interface panel. In some embodiments, powered assist is terminated and the brake is enabled when 95 feet of a 100 foot spool of linear material 268 have been deployed.

Embodiments may prevent or substantially prevent further deployment in a variety of other ways. For example, as previously discussed, the number of revolutions can be used to determine the length of linear material 268 deployed or remaining spooled. The number of revolutions of the motor can also be calculated using a variety of electrical and mechanical means as previously disclosed and as known to one of skill in the art. In some embodiments, instead of deriving length of linear material 268 from observed proxies such as the revolutions of the spool member 220 or motor 254, the controller can compare those revolution counts to a predetermined maximum value for the number of revolutions of the spool member 220 or motor 254, as appropriate. In some embodiments, instead of indirectly measuring the length of linear material 268 deployed, the controller may measure it directly, such as by counting the number of even spaced indicators on the linear material 268 that have passed a sensor or using a variety of other methods known to those of skill in the art for determining the length of linear material 268 that has passed through an aperture, such as by using a single indicator as is disclosed in U.S. Pat. No. 5,440,820 to Hwang.

In some embodiments, where the linear material 268 has been deployed by the automatic reel assembly 100 such that only the proximal portion or strain relief portion of linear material 268 is wound on the rotatable member 220, the user can still initiate the winding operation, as discussed above, by pulling or yanking on the linear material (in the manner described above). The user can yank or pull on the linear material 268 by a certain amount (e.g., by six inches) while in the strain relief position, and pulling by such a length would allow the controller to begin the winding operation, as discussed above. Additionally, if the user pulls on the linear material 268 by an amount less than the desired amount to initiate winding, the spool member 220 can rotate back so that the amount of linear material wound on the spool member 220 coincides with the predetermined strain relief amount. Additional details on reel operation, including in strain relief, can be found in U.S. application Ser. No.

13/802,398,filed Mar. 13, 2013, which is incorporated herein by reference in its entirety and should be considered a part of this specification.

Figure 15:
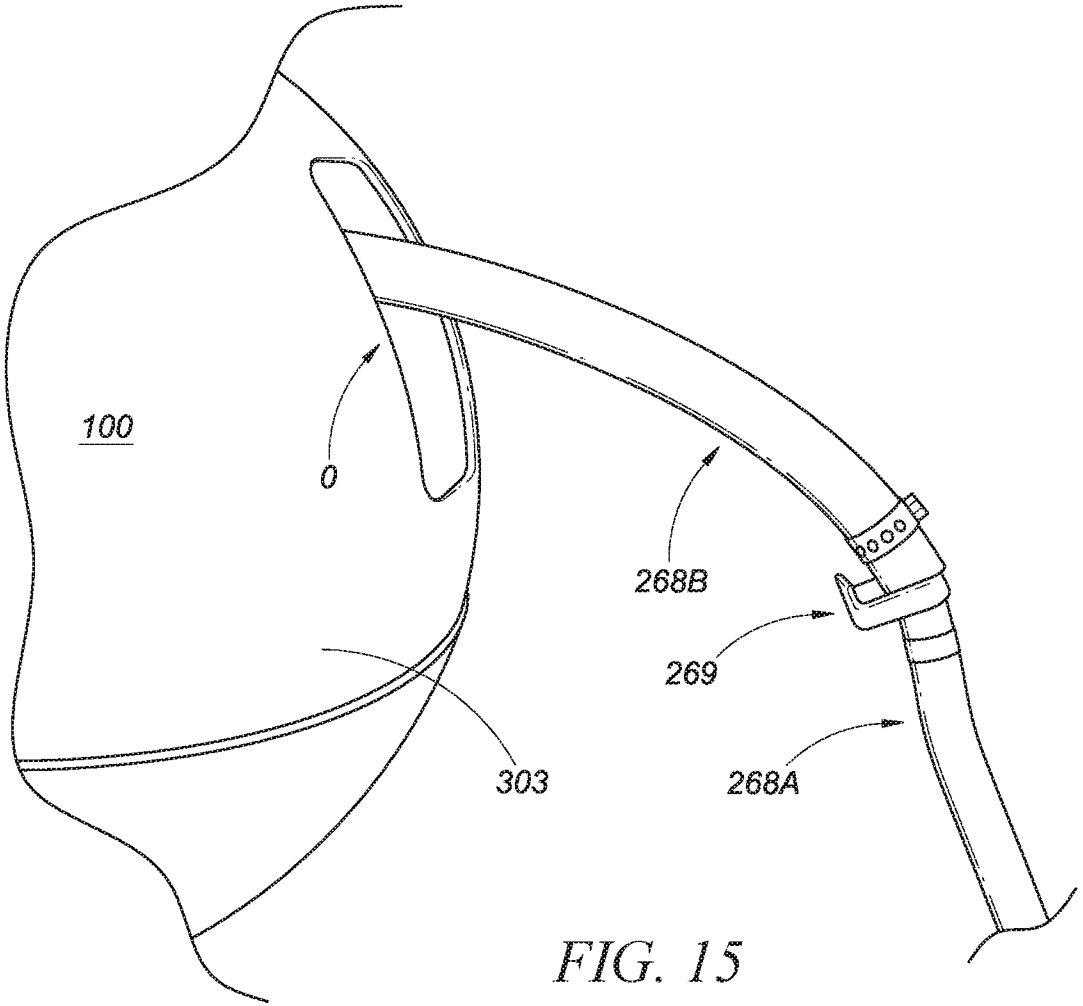
FIG. 15 shows an embodiment of a hose reel with a first hose portion extending out of an opening of the reel housing and coupled to a second hose portion via a connector.

With reference to FIG. 15, the linear material 268 (e.g., a hose, such as an air hose or water hose) can have a first portion 268A (also referred to herein as a working portion) and a second portion 268B (also referred to herein as a connecting portion). The first portion can extend to a distal end portion configured to dispense fluid (shown in FIG. 9A-9B), to which a connector can be coupled for coupling a separate component (e.g., a pneumatic tool, a water hose spray head). A proximal end portion of the first portion 268A can removably connect or attach to a distal end portion of the second portion 268B via a connector 269. A proximal end portion of the second portion 268B can connect or attach to the spool member 220 of the hose reel assembly 100. The second portion 268B can be at least partially disposed about the spool member 220. In the illustrated embodiment, the connector 269 can be a clamp connection assembly. However, in other embodiments, the connector 269 can be a threaded connector, or other suitable connection mechanism.

Figure 16:
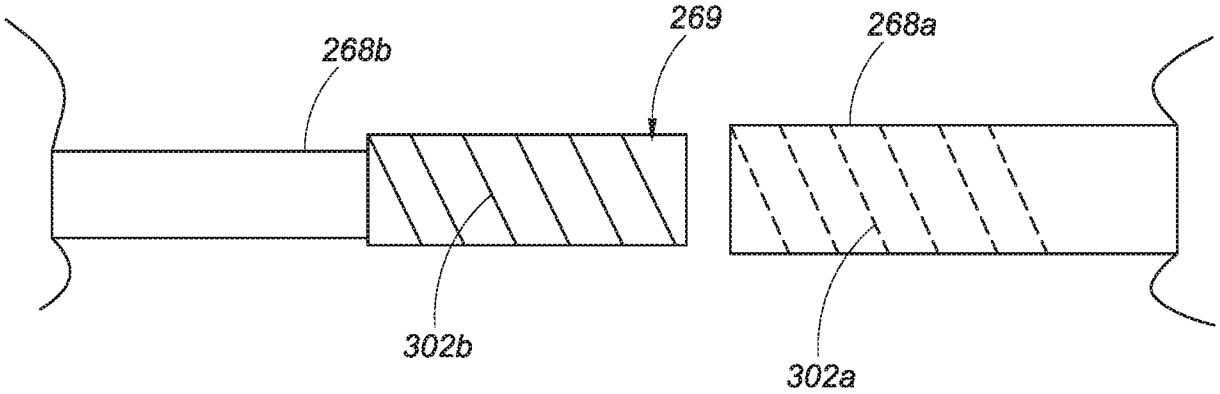
FIG. 16 is a schematic side view illustrating a threaded connector that removable connects two portions of linear material.

For example, as shown in FIG. 16, the first portion 268A of the linear material 268 can have a first threaded portion 302*a*. The second portion 268B of the linear material 268 can be coupled with the connector 269, which can have a second threaded portion 302*b* complementary to the first threaded portion 302*a*. In some embodiments, the connector 269 can be clamped to the distal end portion of the second portion 268B. In other embodiments, the connector 269 can be threaded onto the distal end portion of the second portion 268B. Thus, in various embodiments, the connector 269 can comprise a separate component from the first and second portions 268A, 268B of the linear material, which can enable efficient replacement of the first portion 268A. In the illustrated embodiment, the first threaded portion 302*a* can comprise a female interconnection, and the second threaded portion 302*b* of the connector 269 can comprise a male interconnection. In other embodiments, the first threaded portion 302*a* can comprise a male interconnection, and the second threaded portion 302*b* can comprise a female interconnection. In such other embodiments, for example, the connector 269 can have internal threads and can be coupled (e.g., clamped or threaded) with an interior surface of the distal portion of the second portion 268A. Further, it should be appreciated that an additional separate connector may be provided at the proximal portion of the first portion 268A, or the connector may be integrated with the first portion 268A.

The connector 269 can comprise a lumen through which fluid can flow, such that, when the first portion 268A is connected with the second portion 268B, fluid can flow from the second portion 268A, through the connector 269, and into the first portion 269B. Advantageously, the use of the connector 269, which may normally be disposed in a housing 303 of reel assembly 100 (in which the spool member 220 or hose reel is disposed), can enable the user to interchange the longer first portion 268A without disassembling the entire assembly 100. Moreover, the connector 269 can advantageously be used to connect any suitable linear material, such as pneumatic air hoses, transmission oil hoses, oil supply hoses, or other hoses configured to supply fluids.

Beneficially, the second portion 268B of the linear material (e.g., hose) can have a length selected such that the second portion 268B of the linear material does not extend outside the housing 303 from the spool member 220 during normal operation of the assembly 100, e.g., when the user is not replacing the first portion 268A. Thus, the entire second portion 268B can be disposed within the housing 303 when the first portion 268A is fully or partially unspooled and/or when the first portion 268A is being used to dispense fluid. In various embodiments, for example, a length of the second portion 268B of linear material is less than a length of the first portion 268A of linear material. For example, the length of the second portion 268B of linear material can be no more than three times a circumference of the spool member 220 or hose reel, or no more than 1.5 times the circumference of the spool member 220 or hose reel, or more particularly, no more than the circumference of the spool member 220 or hose reel, no more than 0.75 times the circumference of the spool member 220 or hose reel, or no more than 0.5 times the circumference of the spool member 220 or hose reel. In various embodiments, the length of the first portion 268A can be at least two times the length of the second portion 268B, at least three times the length of the second portion 268B, at least five times the length of the second portion 268B, at least ten times the length of the second portion 268B, at least twenty-five times the length of the second portion 268B, or at least fifty times the length of the second portion 268B.

In operation, the second portion 268B can comprise or be connected with a strain relief portion of the linear material or hose 268 that remains within the housing 303 of the reel assembly 100 as discussed above. In normal operation, the end of the second portion 268B does not extend out of the opening 0 of the housing 303 of the reel assembly 100. That is, in some embodiments, the motor 254 may operate to keep the second portion 268B of the hose 268 within the housing 303 to provide for strain relief, as discussed above. In such embodiments, to withdraw the second portion 268B from the housing 303 (e.g., through the opening O), the user can first turn off the motor 254 (e.g., shut off the reel assembly 100), and then manually pull on the hose 268 to withdraw the second portion 268B of the hose 268 through the opening O of the housing 303. The user can then disconnect the first portion 268A from the second portion 268B and replace the first portion 268A with a new hose. Accordingly, the reel assembly 100 advantageously allows the user to easily replace the hose 268A (e.g., air hose) when worn or damaged. Advantageously, the first portion 268A of the linear material 268 can be replaced without disassembling the reel assembly 100 (e.g., without opening the housing of the reel assembly 100), thereby minimizing the time required to replace a worn or damaged hose. Once the new hose portion 268A has been coupled to the second portion 268B, the reel assembly 100 can be operated as discussed above to wind and unwind the hose 268 on the spool member 220 of the reel assembly 100. The reel assembly 100 can be provided with instructions (e.g., written instructions, such as on a pamphlet, or via an electronic message) on how to replace the hose portion 268A using the steps described above.

In other embodiments, a mechanical element can be configured to prevent or reduce an amount by which the second portion 268B unspools from the reel. FIGS. 17A-17E are schematic perspective views of a strain relief member 301 configured to control an amount by which the second portion 268B of linear material unspools from the spool member 220, according to various embodiments. As explained above, it can be beneficial to maintain the second portion 268B within the housing 303 of the hose reel assembly 100. For example, the relatively short length and relative immobility of the second portion 268B can advantageously increase the lifespan of the second portion 268B, such that only the longer first portion 268A need be replaced from time to time. Thus, it can be important to limit the amount by which the second portion 268B unspools from the spool member 220. During normal operation, the strain relief member 301 (see FIGS. 17C-17E) can be configured to prevent, or to reduce, unspooling of the second portion 268B from the spool member 220. When the user elects to replace the first portion 268A of the linear material (for example, when the first portion 268A is worn, aged, broken, etc.), the user can adjust the strain relief member 301 to at least partially unspool and access the second portion 268B to replace the first portion 268A.

Figure 17A:
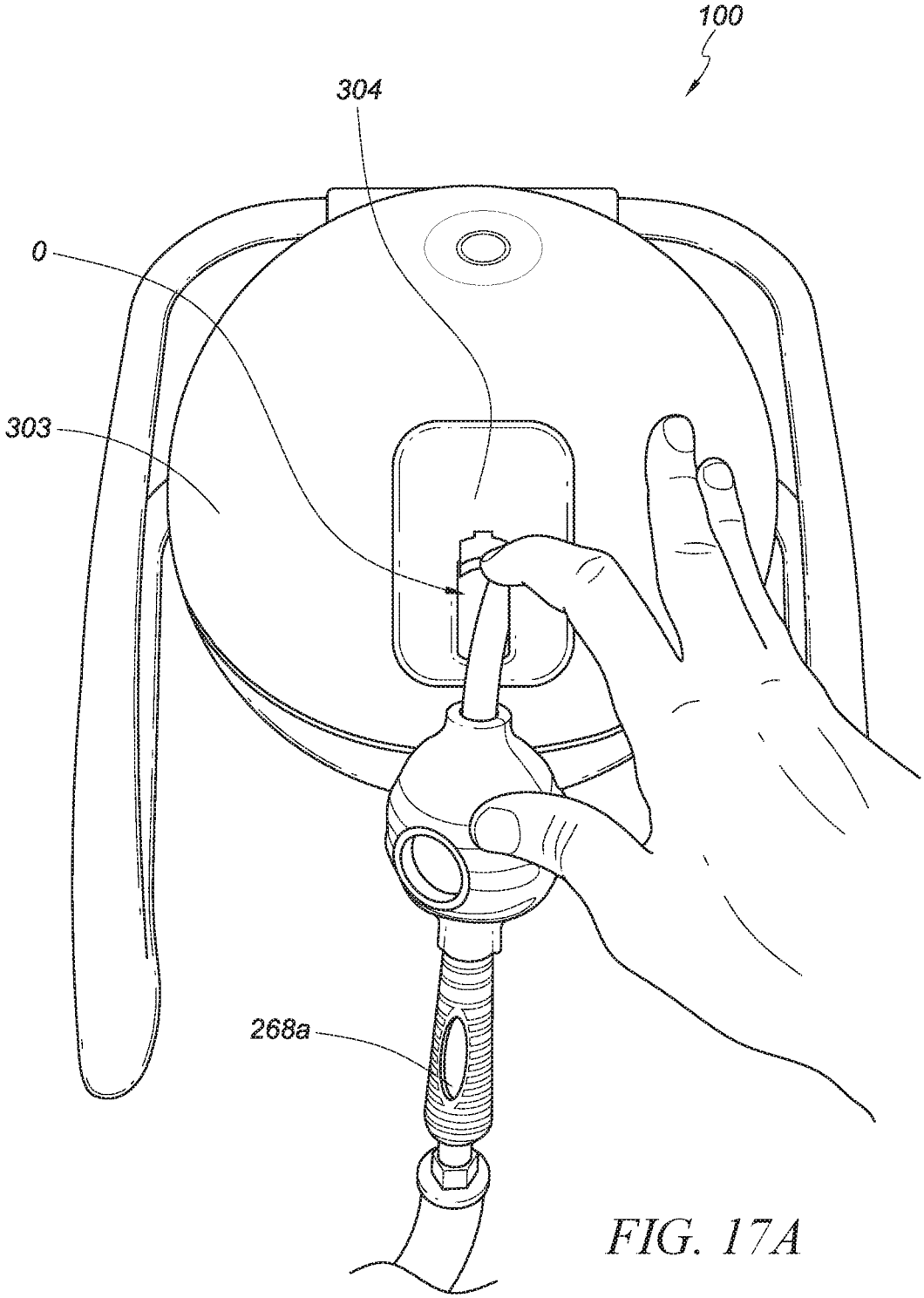
FIGS. 17A-17E are schematic perspective views of a strain relief member configured to control an amount by which a second portion of linear material unspools from the spool member, according to various embodiments.
Figure 17B:
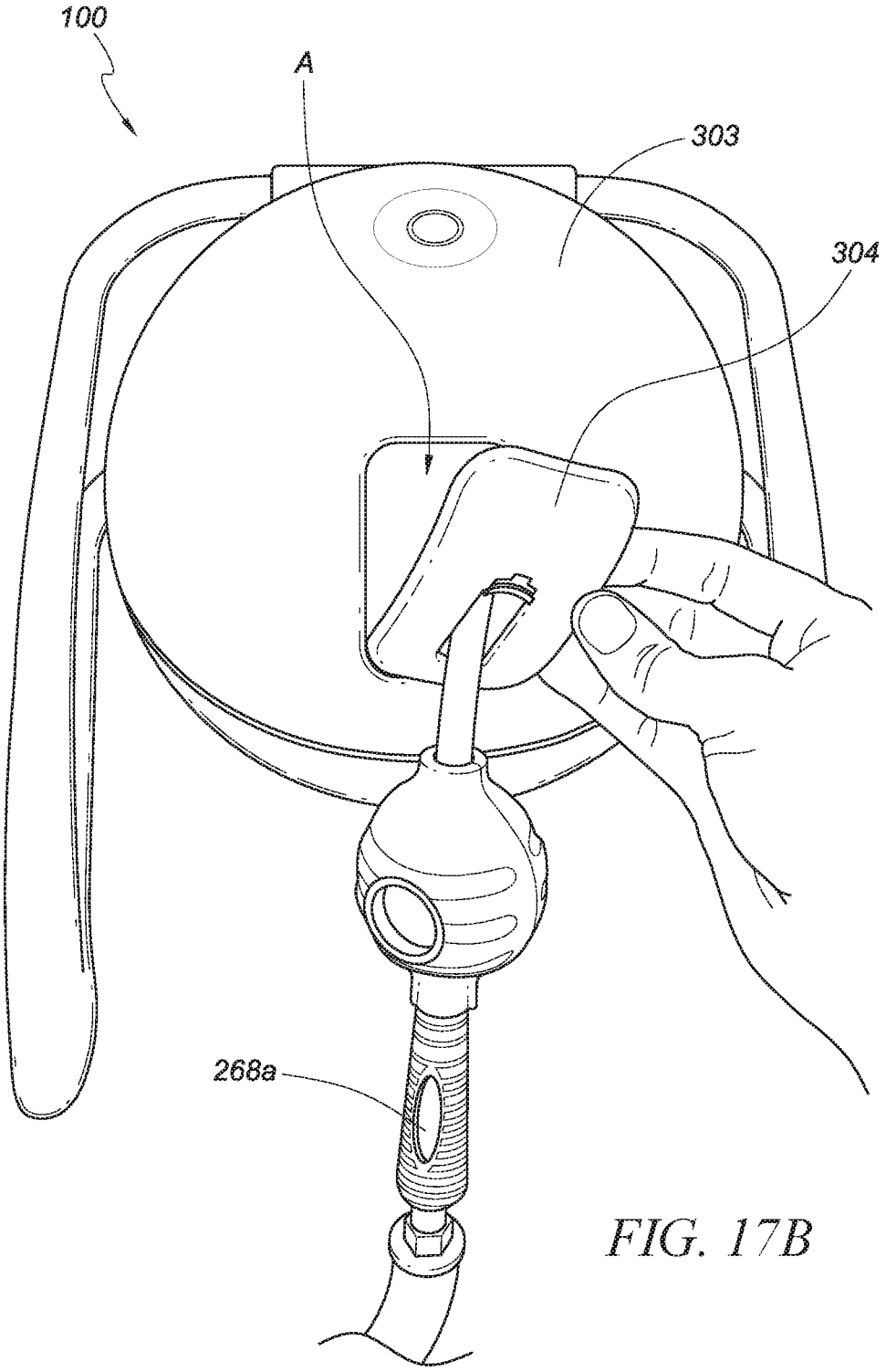

For example, as shown in FIG. 17A, the housing 303 can include a door 304 removably attached to the housing 303. The opening O can be defined through the door 304 and can be sized and shaped to permit the first portion 268A of linear material to pass therethrough. To access the strain relief member 301, the user can engage a latch or other locking device to remove or open the door 304. As shown in FIG. 17B, removing or opening the door 304 can expose the larger aperture A in which the door 304 is normally disposed.

Figure 17C:
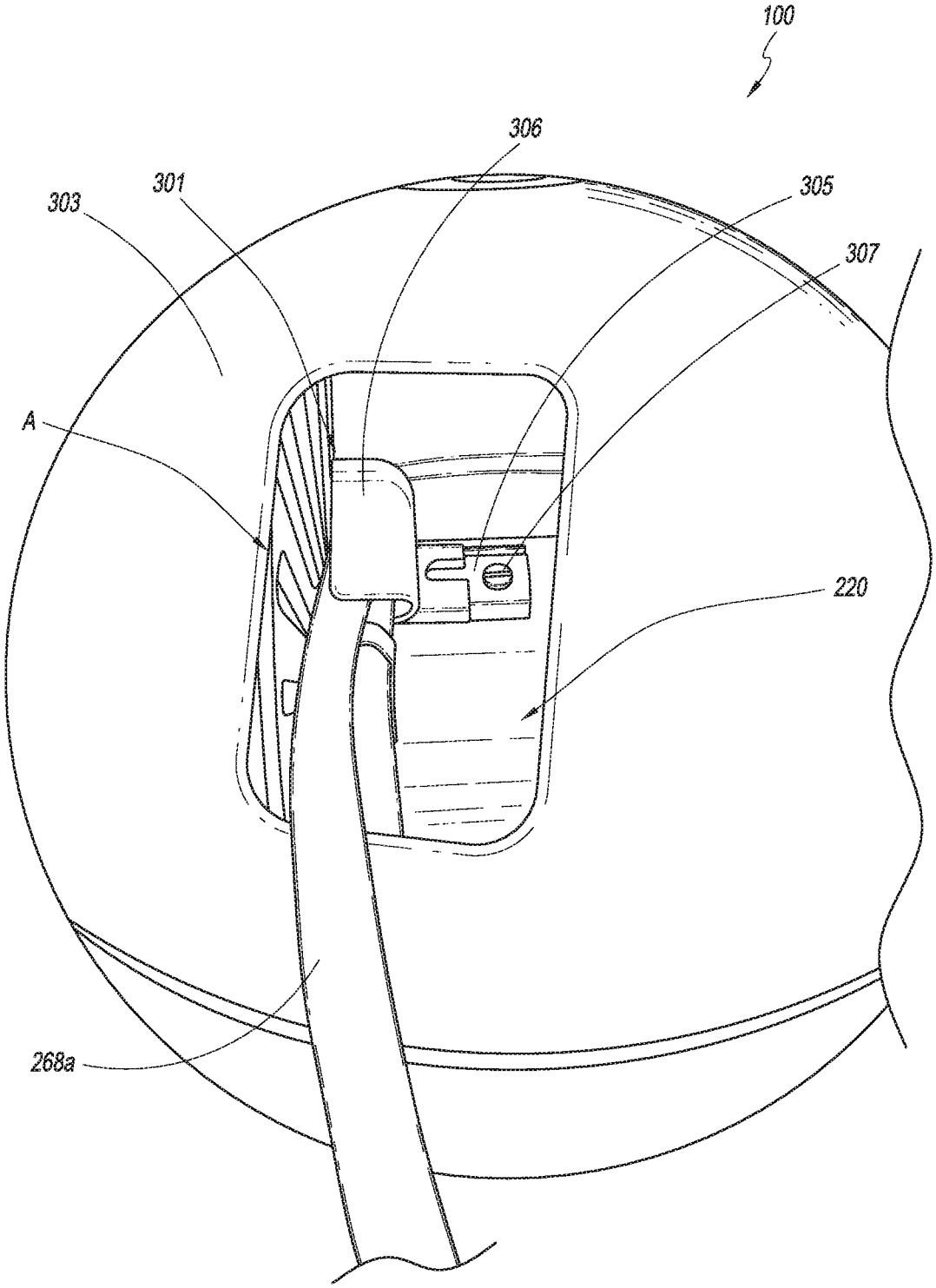

As shown in FIG. 17C, the strain relief member 301 can comprise a locking flange 306 which controls unspooling of the second portion 268B of linear material from the hose reel (e.g., the spool member 220). In FIG. 17C, the locking flange 306 is shown in a first configuration in which the second portion 268B of linear material is secured to the hose reel such that unspooling is prevented or restricted. The connector 269 and second portion 268B are obscured in FIG. 17C by the locking flange 306. For example, in various embodiments, the locking flange 306 may be pressed against the connector 269 or a distal portion of the second portion 268B to secure the connector 269 and/or the second portion 268B to the spool member 220. A support plate 305 can be adjustably connected to the spool member 220 by way of a fastener 307. The fastener 307 can be adjusted by the user to tighten and/or loosen the attachment of the support plate 305 to the spool member 220. The fastener 307 may comprise any suitable type of fastener, such as a screw, bolt, etc.

Figure 17D:
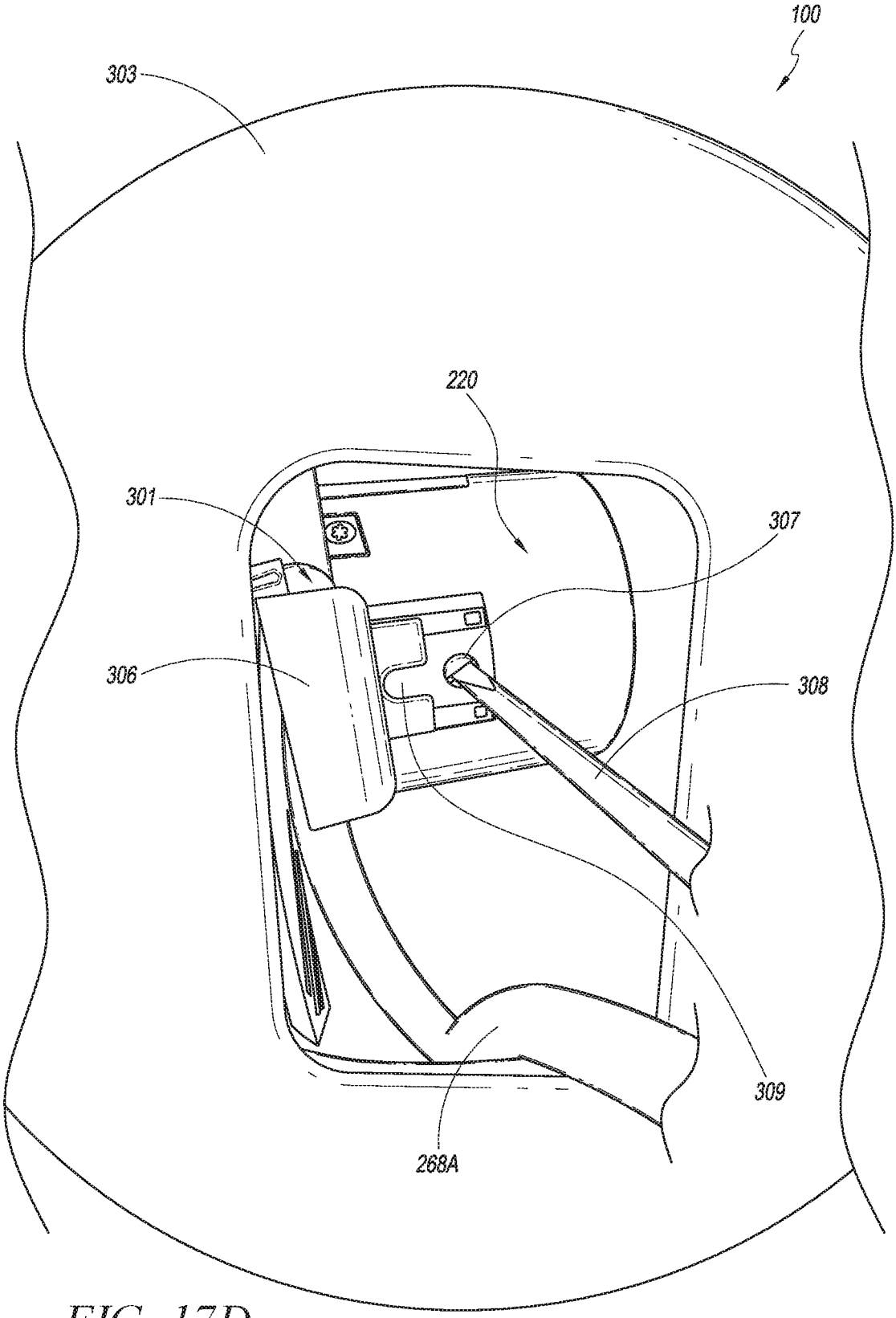
Figure 17E:
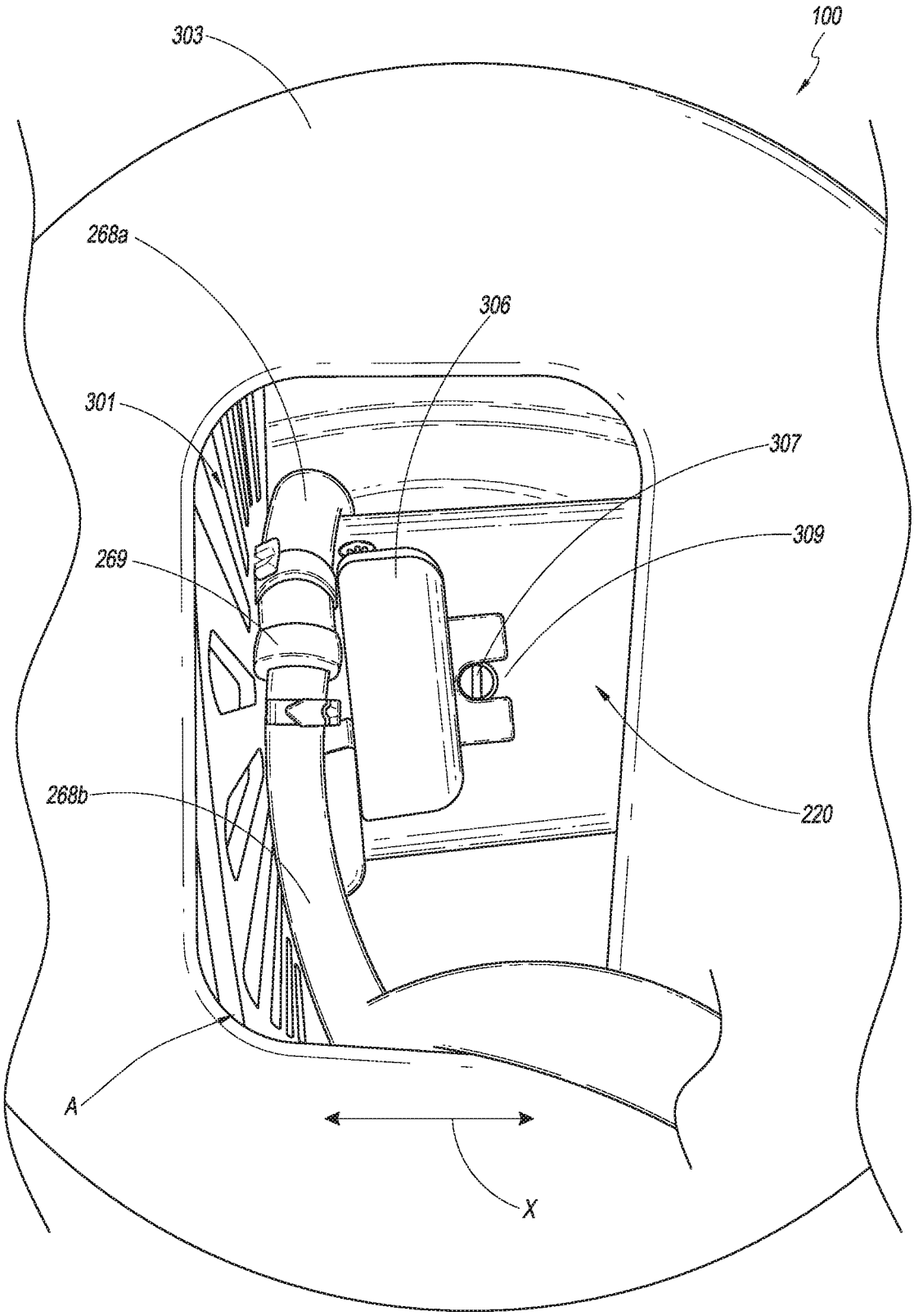

Turning to FIG. 17D, the user can provide a tool 308 (such as a screwdriver, wrench, etc.) to loosen the fit between the support plate 305 and the hose reel or spool member 220. Once suitably loosened, as shown in FIG. 17E, the locking flange 306 can be moved to a second configuration in which the second portion 268B of linear material can at least partially unspool from the hose reel or spool member 220. For example, as shown in FIG. 17E, the user can slide the locking flange 306 along an X direction, which can be generally parallel to the axis of rotation of the spool member 220. Sliding the locking flange 306 along the X direction can uncover the connector 269 and/or the second portion 268B of linear material to enable the second portion 269B of linear material to at least partially unspool from the spool member 220. Moreover, as shown in FIGS. 17D-17E, the locking flange 306 can comprise a notch 309 sized and shaped such that when the locking flange 306 is slid towards the fastener 307, the fastener 307 may be received in the notch 309. Although the locking flange 306 is illustrated as being slidable relative to the spool member 220, in other embodiments, the locking flange 306 can be rotatable relative to the spool member 220 by a hinge or other mechanism to expose the connector 269 and/or second portion 268B. In still other embodiments, the locking flange 306 can be removable from the spool member 220 to expose the connector 269 and/or second portion 268B.

When the connector 269 is exposed, the user can at least partially unspool the second portion 268B of the linear material so as to be able to access the distal portion of the second portion 268B. The user can replace the first portion 268A by disengaging the connector 269, e.g., by unclamping or unthreading the first portion 268A from the second portion 268B. The user can provide a new replacement first portion 268A and can connect the replacement first portion 268A to the second portion 268B by engaging the connector 269, e.g., by clamping or threading the proximal end portion of the first portion 268A to the distal end portion of the second portion 268B. Once connected, the user can secure the connector 269 and/or the second portion 268B to the spool member 220 by adjusting the strain relief member 301. For example, the user can slide the locking flange 306 in the opposite direction along the X direction such that the locking flange 306 covers the connector 269 and/or the distal portion of the second portion 268B. In other embodiments, it should be appreciated, that the locking flange 306 can cover the proximal end portion of the first portion 268A, which may also control an amount by which the second portion 268B unspools from the hose reel or spool member 220. The user may tighten the fastener 307 with the tool 308 to tighten the fit between the support plate 305 and the spool member 220. The user can replace or close the door 304 and begin operation of the hose reel assembly 100.

Figure 18:
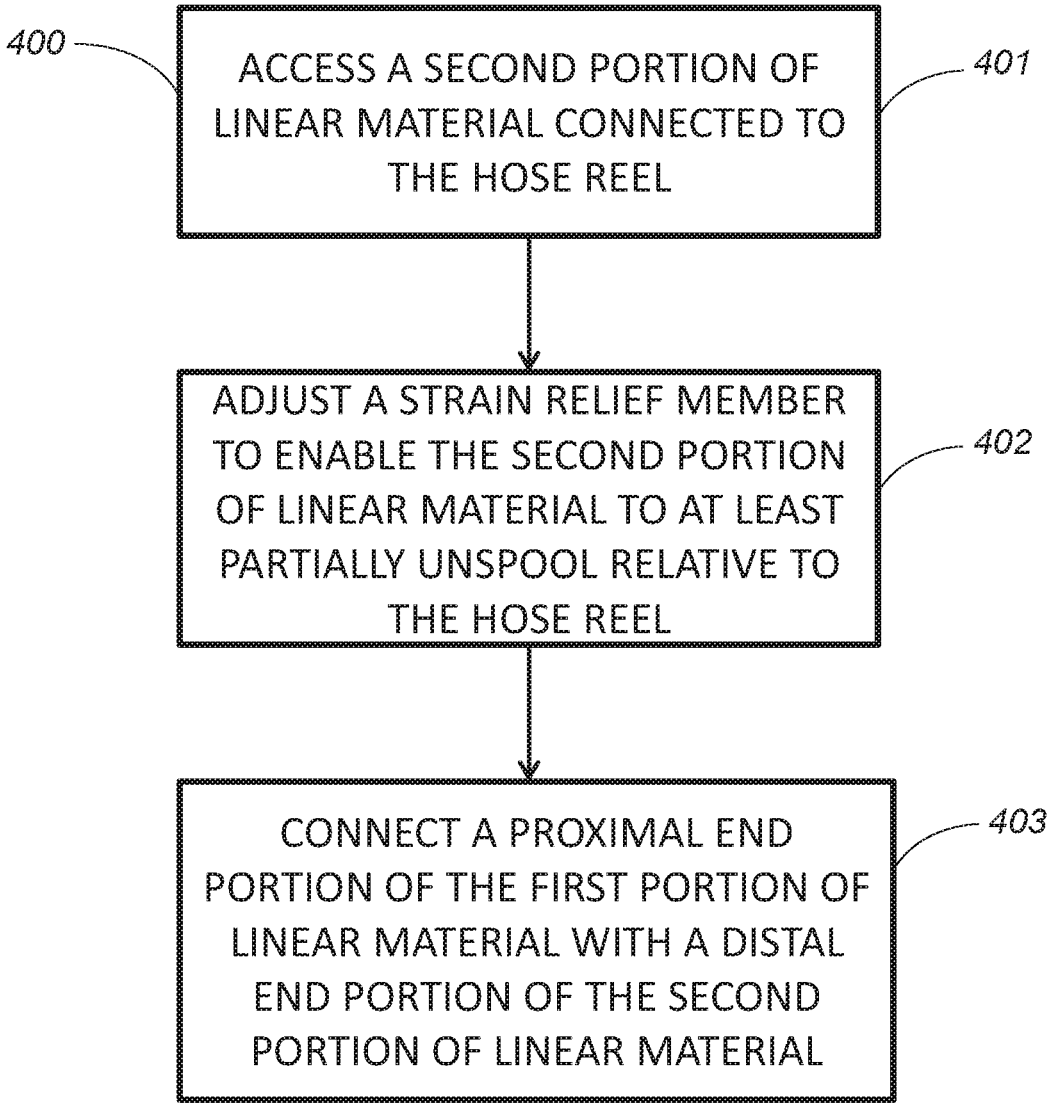
FIG. 18 is a flowchart illustrating a method for connecting a first portion of linear material to a hose reel.

FIG. 18 is a flowchart illustrating a method 400 for connecting a first portion of linear material to a hose reel. The method 400 begins in a block 401 in which a second portion of linear material (such as an air hose) connected to the hose reel is accessed by a user. As explained herein, the user can remove or open a door on the housing of the hose reel assembly to access the second portion of linear material and a connector configured to connect the second portion to the first portion. Beneficially, the user can access the connector and second portion of linear material without disassembling a housing in which the second portion of linear material is disposed.

In a block 402, a strain relief member can be adjusted to enable the second portion of linear material to be at least partially unspooled relative to the hose reel. For example, the user can adjust a fastener (such as a screw or bolt) to loosen the fit between a support plate and the hose reel. The user can slide a locking flange along a direction generally parallel to an axis of rotation of the hose reel to uncover or expose the second portion of linear material and/or the connector. In other embodiments, the user can rotate the locking flange relative to the hose reel or can remove the locking flange from the hose reel to uncover or expose the second portion and/or the connector.

In a block 403, a proximal end portion of the first portion of linear material can be connected with a distal end portion of the second portion of linear material. For example, in some arrangements, the proximal end portion of the first portion can be threaded with an intervening connector coupled with the distal end portion of the second portion. In other arrangements, the proximal end portion of the first portion can be clamped to the distal end portion of the second portion and/or with a connector coupled with the distal end portion of the second portion. When the first portion of linear material is to be replaced, the user can disconnect the proximal portion of the first portion of linear material from the distal portion of the second portion of linear material.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a sub combination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Of course, the foregoing description is that of certain features, aspects and advantages of the present invention, to which various changes and modifications can be made without departing from the spirit and scope of the present invention. Moreover, the reel assembly need not feature all of the objects, advantages, features and aspects discussed above. Thus, for example, those skill in the art will recognize that the invention can be embodied or carried out in a manner that achieves or optimizes one advantage or a group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or subcombinations of these specific features and aspects of embodiments may be made and still fall within the scope of the invention. Accordingly, it should be understood that various features and aspects of the disclosed embodiments can be combined with or substituted for one another in order to form varying modes of the discussed reel assembly.

What is claimed is:

1. A hose reel assembly comprising:

a hose reel rotatable about a reel axis;

a first portion of linear material having a first proximal end portion and a first distal end portion, the first distal end portion configured to dispense a fluid;

a second portion of linear material having a second proximal end portion connected to the hose reel and a second distal end portion, the second portion of linear material at least partially wound around a spool member of the hose reel;

a connector which removably attaches the second distal end portion of the second portion of linear material with the first proximal end portion of the first portion of linear material, the connector comprising a lumen configured to convey the fluid therethrough; and a strain relief member configured to control an amount by which the second portion of linear material unspools from the hose reel, the strain relief member being movable between a first configuration in which unspooling of the linear material is restricted and a second configuration in which unspooling of the linear material is permitted.

2. The hose reel assembly of claim 1, further comprising a first threaded portion at the first proximal end portion of the first portion of linear material and a second threaded portion at the connector, the connector coupled with the second distal end portion of the second portion of linear material.

3. The hose reel assembly of claim 1, wherein the connector comprises a clamp assembly which removably attaches the first proximal end portion of the first portion of linear material with the second distal end portion of the second portion of linear material.

4. The hose reel assembly of claim 1, wherein the first portion of linear material comprises an air hose.

5. The hose reel assembly of claim 1, further comprising a housing, the hose reel disposed in the housing, wherein the second portion of linear material has a length selected such that the second portion of linear material does not extend outside the housing from the hose reel during normal operation.

6. The hose reel assembly of claim 5, wherein the housing comprises an opening, the first portion of linear material extending through the opening.

7. The hose reel assembly of claim 6, further comprising a door removably connected to the housing, the opening disposed through the door, the connector accessible through the door.

8. The hose reel assembly of claim 1, wherein a length of the second portion of linear material is less than a length of the first portion of linear material.

9. The hose reel assembly of claim 8, wherein the length of the second portion of linear material is no more than three times a circumference of the hose reel.

10. The hose reel assembly of claim 9, wherein the length of the second portion of linear material is no more than 1.5 times the circumference of the hose reel.

11. The hose reel assembly of claim 1, wherein the strain relief member comprises a locking flange which controls unspooling of the second portion of linear material from the hose reel.

12. The hose reel assembly of claim 11, wherein the locking flange is movable relative to the hose reel such that the locking flange has a first configuration in which the second portion of linear material is secured to the hose reel such that unspooling is prevented or restricted, and a second configuration in which the second portion of linear material can at least partially unspool from the hose reel.

13. The hose reel assembly of claim 12, wherein the locking flange is slidable to move between the first configuration and the second configuration.

14. The hose reel assembly of claim 12, further comprising a support plate and a fastener which connects the support plate to the hose reel, the fastener operable to adjust the fit between the support plate and the hose reel to cause the locking flange to move between the first configuration and the second configuration.

15. A hose reel assembly comprising:

a housing;

a hose reel rotatable about a reel axis, the hose reel disposed in the housing;

a connecting portion of linear material fluidly connected to and at least partially disposed about a spool member of the hose reel, the connecting portion of linear material disposed entirely within the housing during normal operation of the hose reel assembly;

a connector configured to removably attach a distal end portion of the connecting portion of linear material with a proximal end portion of a working portion of linear material, the connector comprising a lumen configured to convey the fluid therethrough;

a strain relief member configured to control an amount by which the connecting portion of linear material unspools from the hose reel, the strain relief member being movable between a first configuration in which unspooling of the linear material is restricted and a second configuration in which unspooling of the linear material is permitted; and a door connected to the housing, the connector accessible through the door.

16. The hose reel assembly of claim 15, further comprising the working portion of linear material.

17. The hose reel assembly of claim 15, wherein a length of the connecting portion of linear material is no more than three times a circumference of the hose reel.

18. The hose reel assembly of claim 17, wherein the length of the connecting portion of linear material is no more than 1.5 times the circumference of the hose reel.

19. A method for connecting a first portion of linear material to a hose reel, the method comprising:

accessing a second portion of linear material which is connected to the hose reel and at least partially disposed about a spool member of the hose reel without disassembling a housing in which the second portion of linear material is disposed;

adjusting a strain relief member from a first configuration in which unspooling of the linear material is restricted to a second configuration in which unspooling of the linear material is permitted to enable the second portion of linear material to at least partially unspool relative to the hose reel; and connecting a proximal end portion of the first portion of linear material with a distal end portion of the second portion of linear material.

20. The method of claim 19, wherein adjusting the strain relief member comprises sliding a locking flange to uncover the second portion of linear material.

21. The method of claim 19, wherein connecting the proximal end portion comprises threading the proximal end portion of the first portion of linear material with the distal end portion of the second portion of linear material.

* * * * *